US009512726B2

(12) United States Patent
Ren et al.

(10) Patent No.: US 9,512,726 B2
(45) Date of Patent: Dec. 6, 2016

(54) IMPELLER AND METHOD FOR DRIVING FLUIDS USING THE SAME

(71) Applicant: Johnson Electric S.A., Murten (CH)

(72) Inventors: Guodong Ren, Shenzhen (CN); Anbang Chen, Shenzhen (CN); Di Wang, Shenzhen (CN); Rui Feng Qin, Hong Kong (CN)

(73) Assignee: JOHNSON ELECTRIC S.A., Murten (CH)

( * ) Notice: Subject to any disclaimer, the term of this patent is extended or adjusted under 35 U.S.C. 154(b) by 664 days.

(21) Appl. No.: 13/949,123

(22) Filed: Jul. 23, 2013

(65) Prior Publication Data

US 2014/0064973 A1 Mar. 6, 2014

(30) Foreign Application Priority Data

Jul. 24, 2012 (CN) ..... 2012 1 0256868
Jul. 19, 2013 (CN) ..... 2013 1 0306092

(51) Int. Cl.

| | |
|---|---|
| ***F04D 29/32*** | (2006.01) |
| ***F01D 5/10*** | (2006.01) |
| ***F04D 29/38*** | (2006.01) |
| ***F04D 29/66*** | (2006.01) |

(Continued)

(52) U.S. Cl.

CPC ..... *F01D 5/10* (2013.01); *F04D 19/002* (2013.01); *F04D 25/082* (2013.01); *F04D 29/32* (2013.01); *F04D 29/329* (2013.01); *F04D 29/388* (2013.01); *F04D 29/666* (2013.01);

(Continued)

(58) Field of Classification Search

CPC ..... F04D 19/00; F04D 29/32; F04D 29/329; F04D 29/388; F04D 29/666; F05D 2260/961; F05D 2260/96; F01D 5/10

See application file for complete search history.

(56) References Cited

U.S. PATENT DOCUMENTS 7,086,825 B2 * 8/2006 Wang ..... F04D 29/326 415/173.6
7,507,068 B2 * 3/2009 Lin ..... F04D 25/082 415/176

(Continued)

FOREIGN PATENT DOCUMENTS

CN 102086888 A 6/2011
CN 102144101 A 8/2011

*Primary Examiner* — Ninh H Nguyen

(74) *Attorney, Agent, or Firm* — Muncy, Geissler, Olds & Lowe, P.C.

(57) ABSTRACT

Disclosed are mechanisms for an impeller (10, 20, 40) and method of reducing noise levels while driving fluids with impellers. Exemplary implementations include a hub (21, 41) and multiple blades (22) separably attached to or inseparably formed on the hub. The hub may be used to effectively reduce noise levels during operations of the impeller by having a first cylindrical feature (261), a first number of first ribs (27, 47, 706), and a second number of second ribs (281, 48, 708), while maintaining substantially similar mechanical properties or operational characteristics. The hub may further optionally include a second substantially cylindrical feature (704) that is separably attached to or is inseparably formed on the hub to further enhance one or more properties or characteristics of the hub while serving to reduce the noise level of the impeller.

28 Claims, 16 Drawing Sheets

(51) Int. Cl.
*F04D 19/00* (2006.01)
*F04D 25/08* (2006.01)

(52) U.S. Cl.
CPC .... *F05D 2260/96* (2013.01); *F05D 2260/961* (2013.01); *Y10T 29/49332* (2015.01)

(56) References Cited

U.S. PATENT DOCUMENTS

| | | | | |
|---|---|---|---|---|
| 8,152,484 | B2 * | 4/2012 | Bilodeau | F16D 1/116 416/169 A |
| 8,157,524 | B2 | 4/2012 | Nicgorski et al. | |
| 8,899,930 | B2 * | 12/2014 | Innocenti | B60K 11/02 415/143 |
| 2011/0236211 | A1 | 9/2011 | Schneider et al. | |
| 2012/0163991 | A1 | 6/2012 | Nicgorski et al. | |

* cited by examiner

IMPELLER AND METHOD FOR DRIVING FLUIDS USING THE SAME

CROSS REFERENCE TO RELATED APPLICATIONS

This application claims the benefit of Chinese patent application serial no. 201310306092.1 which is filed on Jul. 19, 2013 and in turn claims the benefit of Chinese patent application serial no. 201210256868.9 having a filing date of Jul. 24, 2012. The entire content of the aforementioned patent applications is hereby incorporated by reference for all purposes.

FIELD OF THE APPLICATION

Various embodiments described herein relate to an assembly including a fan, an impeller, a turbine, a propeller, or any apparatus having multiple vanes or blades (hereinafter impeller) that act on fluids.

BACKGROUND

Impellers have a broad range of applications. For example, an impeller may be found in automobiles, appliances, or other fields for, for example, actively cooling or dissipating heat away from some heat generating components, climate control, thermal comfort, vehicle & machinery cooling systems, ventilation, fume extraction, winnowing (separating chaff of cereal grains), removing dust (vacuum cleaner), drying, providing draft for a fire, powering high speed boats with water jets. Impeller assembly may include the rotor (e.g., the impeller itself) that has an rotating or spinning arrangement of multiple vanes or blades (hereinafter blades) of various sizes attached to a hub to act on fluids through an output shaft of the power source. An impeller design may be subject to one or more requirements including, for example, structural strength or stress requirement, fatigue requirement, reliability requirement, flow rate requirement, noise requirement, operating efficiency requirement, cost, material selection requirement, etc. More specifically, the hub design in conventional impellers usually includes stiffeners to reinforce the structure of the impeller in one or more degrees of freedom. Nonetheless, conventional may transfer vibrations or fail to effectively suppress or reduce the vibrations between the blades or vanes of an impeller and one or more remaining components (e.g., the power source such as an electric motor) during the operation, ramping up of the power source from a complete stop to operational speed(s), or coasting down from operational speed(s) to a complete stop. Such vibrations are known to cause noises.

Thus, there exists a need for an improved impeller to achieve some or all of the requirements. Some embodiments are directed at improving one or more structural characteristics of the impeller while improving the noise performance or reducing or suppressing noise levels during operations of the impeller. Some of these embodiments further provide improved noise performance or reduced or suppressed noise levels during operations of the impeller while reducing or even eliminating any negative impact on the airflow requirement(s) or goal(s). In some of these embodiments, an improved impeller further reduce or even eliminate any negative impact on the strength, integrity, or reliability of the impeller assembly or one or more individual parts thereof.

SUMMARY

Some embodiments are directed at an improved impeller that transmits power by converting rotational motion into thrust. It shall be noted that although an impeller may include a rotor inside a tubular structural member or conduit (e.g., a tube) to increase or decrease the pressure and flow of a fluid in some embodiments, various embodiments described herein apply with full and equal effect to impellers, fans, or propellers (hereinafter impeller) with various detailed implementations described herein or equivalents thereof, unless otherwise specifically claimed or recited. During operation, a pressure difference is produced between the forward and rear surfaces of the blades, and a fluid (such as air, water, or other types of fluids) is accelerated behind the blade.

As described in the Background section, a conventional impeller design usually includes a hub with one or more stiffeners to reinforce various characteristics of the impeller (e.g., structural strength, rigidity, etc.) in one or more degrees of freedom. Nonetheless, conventional impeller designs often transfer vibrations or fail to effectively suppress or reduce the vibrations between the blades or vanes of an impeller and one or more remaining components (e.g., the power source such as an electric motor) during its operation at various operational speeds, ramping up of the power source from a complete stop to operational speed(s), or coasting down from operational speed(s) to a complete stop (hereinafter operation or operations collectively). In conventional designs, such a coupling or transfer of vibrations is often caused by one or more factors such as the coupling of structural elements between the blades and such one or more remaining components. Some embodiments are directed at an impeller with a reduced level of noise during the operations (e.g., during coast down where the impeller goes from a certain rotation or spinning speed to a complete halt), while reducing or even eliminating any impact on the airflow through the power source for cooling the power source or any impact on the strength, integrity, or reliability of the impeller assembly or one or more individual parts thereof. These embodiments provides an impeller assembly, which includes a hub and a number of blades. The hub comprises a top member and one continuous piece of sidewall or multiple discontinuous pieces of sidewall members (e.g., a continuous piece of sidewall with one or more cutouts or openings) along the periphery of the top member of the hub. The impeller blades extend radially from the sidewall outwardly to drive fluids during operation. The top member of the hub also comprise an outer surface and an inner surface opposite the outer surface, where a plurality of first ribs are formed either inseparably or separably on the inner surface of the top member.

Some embodiments are directed at an improved impeller having one or more improved structural characteristics of the impeller while improving the noise performance or reducing or suppressing noise levels during operations of the impeller. Some of these embodiments further provide improved noise performance or reduced or suppressed noise levels during operations of the impeller while reducing or even eliminating any negative impact on the airflow requirement(s) or goal(s). In some of these embodiments, an improved impeller further reduce or even eliminate any negative impact on the strength, integrity, or reliability of the impeller assembly or one or more individual parts thereof.

In some embodiments, the impeller includes one or more stiffeners to reinforce one or more structural characteristics in one or more degrees of freedom so as to decouple, suppress, or reduce the vibrations between the blades of the impeller and one or more remaining components of the impeller without using any continuous piece of sidewall or one or more continuous pieces of radial stiffeners and thus effectively improve the noise performance or suppress or reduce the noise levels during operations of the impeller. In some embodiments, the impeller includes at least one stiffener that does not form a continuous stiffener in a radial direction to bridge or connect the at least one stiffener to the sidewall of the hub to which the blades are attached so as to reinforce one or more structural characteristics in one or more degrees of freedom and to improve the noise performance or to decouple, suppress, or reduce the vibrations between the blades of the impeller and one or more remaining components of the impeller In some embodiments, a first rib of the plurality of first ribs comprises a straight structural member of various cross-section profiles and is at an angle relative to a radial line extending outwardly from the center of the hub. In some embodiments, each of the plurality of first ribs has the same angle and orientation relative to the respective radial line extending outwardly from the center of the hub. In some other embodiments, the orientation or angle of the first rib of the plurality of first ribs may be different from that of the second rib of the plurality of first ribs. An orientation or an angle between a first rib and the corresponding radial line from the center of the hub of a first rib (hereinafter angle) may be determined by the direction of rotation or spinning of the impeller assembly in some embodiments. In some of these embodiments, the orientation or the angle may be determined based at least in part on one or more analysis results to determine the improved or optimal configuration for a rib of the plurality of first ribs. For example, an orientation or an angle of a rib may be determined based on the results of a computation fluid dynamics (CFD) analysis, structural analysis, resonance or harmonic analysis, dynamic analysis, any other analyses, or one or more combinations thereof in some embodiments.

In some embodiments, a first rib of the plurality of first ribs may comprise a curvilinear shape with a constant or variable cross-sectional profile along the curvilinear shape. In some embodiments, each of the plurality of first ribs has identical geometric dimensions as designed, although the as-manufactured first ribs may exhibit one or more slightly different dimensions due to, for example, manufacturing or design slacks or tolerances. In some embodiments, at least two of the plurality of first ribs may have at least one different dimension as designed. For example, the plurality of first ribs may include a straight rib and a curvilinear rib in some embodiments. As another example, the plurality of first ribs may include two curvilinear ribs having one or more different curved lines or the same curved lines but different profiles. As another example, the plurality of first ribs may include two straight ribs having different profiles, different orientations, or different angles.

In some embodiments, the hub to which the number of blades are attached may include a plurality of separable or inseparable second ribs along the inner surface of the sidewall of the hub. A second rib may be a straight structural member or a curvilinear structural member along the inner sidewall (opposite the outer sidewall to which the number of blades are attached). A straight second rib may be parallel along the sidewall of the hub to the axis of rotation in some embodiments and may be at one or more angles from the axis of rotation in other embodiments. In some of these embodiments, each of the plurality of the second ribs corresponds to a first rib of the plurality of first ribs, although a one-to-one correspondence is not required. Each of the first rib may be connected to or disjoint from the corresponding second rib.

The profile or the shape of a second rib may be similarly determined based at least in part upon, for example but not limited to, direction of rotation or spinning of the impeller assembly in some embodiments. In some of these embodiments, the profile or the shape of the a second rib may be determined based at least in part on one or more analysis results to determine the improved or optimal configuration for a rib of the plurality of first ribs. For example, an orientation or an angle of a rib may be determined based on the results of a CFD analysis, structural analysis, resonance or harmonic analysis, dynamic analysis, any other analyses, or one or more combinations thereof in some embodiments.

Some embodiments further include one or more circular or substantially circular rings that are concentric with the axis of rotation or spinning (e.g., the center of the hub or the impeller as designed) along the inner surface or outer surface of the top member of the hub. It shall be noted that the term "substantially" or "substantial" such as in the "substantially circular rings" is used herein to indicate that certain features, although designed or intended to be perfect (e.g., perfectly circular), the fabrication or manufacturing tolerances, the slacks in various mating components or assemblies due to design tolerances or normal wear and tear, or any combinations thereof may nonetheless cause some deviations from this designed, perfect characteristic. Therefore, one of ordinary skill in the art will clearly understand that the term "substantially" or "substantial" is used here to incorporate at least such fabrication and manufacturing tolerances, the slacks in various mating components or assemblies, or any combinations thereof.

More details about the improved impeller are described in the Detailed Description section with reference to FIGS. 1-11 as provided below.

BRIEF DESCRIPTION OF THE DRAWINGS

The drawings illustrate the design and utility of embodiments, in which similar elements are referred to by common reference numerals. These drawings are not necessarily drawn to scale. In order to better appreciate how the above-recited and other advantages and objects are obtained, a more particular description of the embodiments will be rendered which are illustrated in the accompanying drawings. These drawings depict only exemplary embodiments and are not therefore to be considered limiting of the scope of the claims.

DETAILED DESCRIPTION

Figure 1:
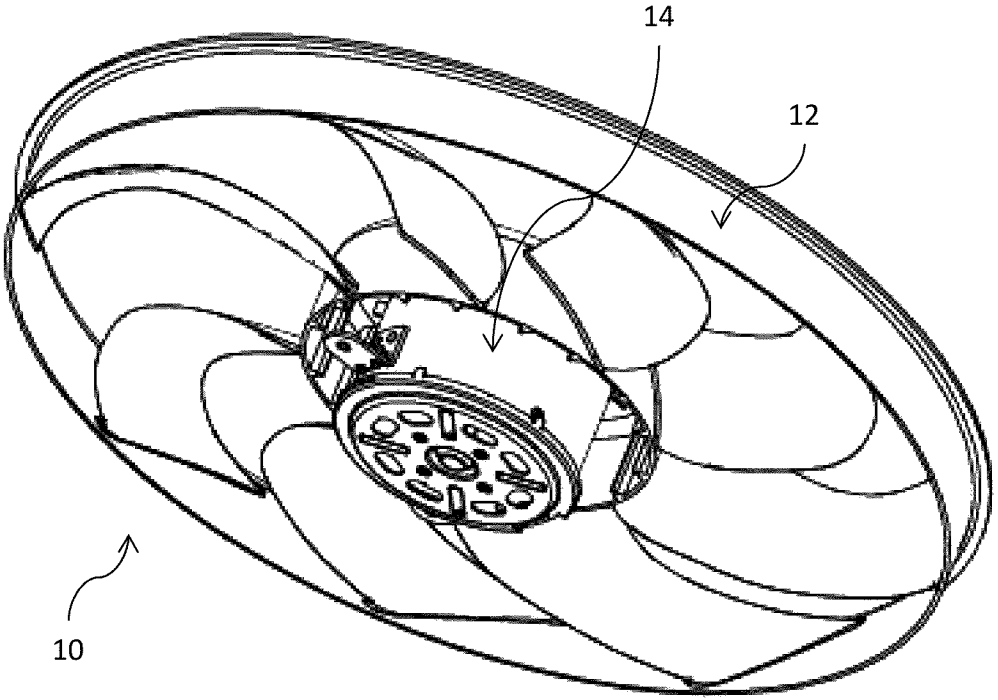
FIG. 1 illustrates a perspective view of a part of an impeller assembly in some embodiments.

Various features are described hereinafter with reference to the figures. It shall be noted that the figures are not drawn to scale, and that the elements of similar structures or functions are represented by like reference numerals throughout the figures. It shall also be noted that the figures are only intended to facilitate the description of the features for illustration and explanation purposes, unless otherwise specifically recited in one or more specific embodiments or claimed in one or more specific claims. The drawings figures and various embodiments described herein are not intended as an exhaustive illustration or description of various other embodiments or as a limitation on the scope of the claims or the scope of some other embodiments that are apparent to one of ordinary skills in the art in view of the embodiments described in the application. In addition, an illustrated embodiment need not have all the aspects or advantages shown.

An aspect or an advantage described in conjunction with a particular embodiment is not necessarily limited to that embodiment and may be practiced in any other embodiments, even if not so illustrated, or if not explicitly described. Also, reference throughout this specification to "some embodiments" or "other embodiments" means that a particular feature, structure, material, process, or characteristic described in connection with the embodiments is included in at least one embodiment. Thus, the appearances of the phrase "in some embodiments", "in one or more embodiments", or "in other embodiments" in various places throughout this specification are not necessarily referring to the same embodiment or embodiments.

FIG. 1 illustrates a perspective view of a part of an impeller assembly that may be used in various applications in some embodiments. More specifically, FIG. 1 illustrates an impeller assembly 10 that includes an impeller 12 and is driven by a power source 14. For example, the impeller 12 may be attached to for example, the output shaft (not shown) of the power source 14 such that the blades of the impeller 12 may act on the fluid during operation. It shall be noted that although FIG. 1 illustrates a direct-drive impeller assembly, the direct-driving characteristic is not intended to limit other embodiments where impellers may also be driven by belts, pulleys, gears, etc. In addition or in the alternative, the power source that drives the impeller 12 is not limited to an electric motor. Rather, an internal combustion engine or a hydraulic motor may also be used to drive the impeller with various types of power transmission mechanism between the power source and the impeller known in the field. It shall also be noted that although FIG. 1 shows that the blades reside inside a tubular structural member or conduit (to which reference numeral 12 points), various other impeller designs are also contemplated, and the existence of the tubular structural member or conduit in FIG. 1 is thus not intended to limit the scope of such other impeller designs, unless otherwise specified or claimed.

Figure 2:
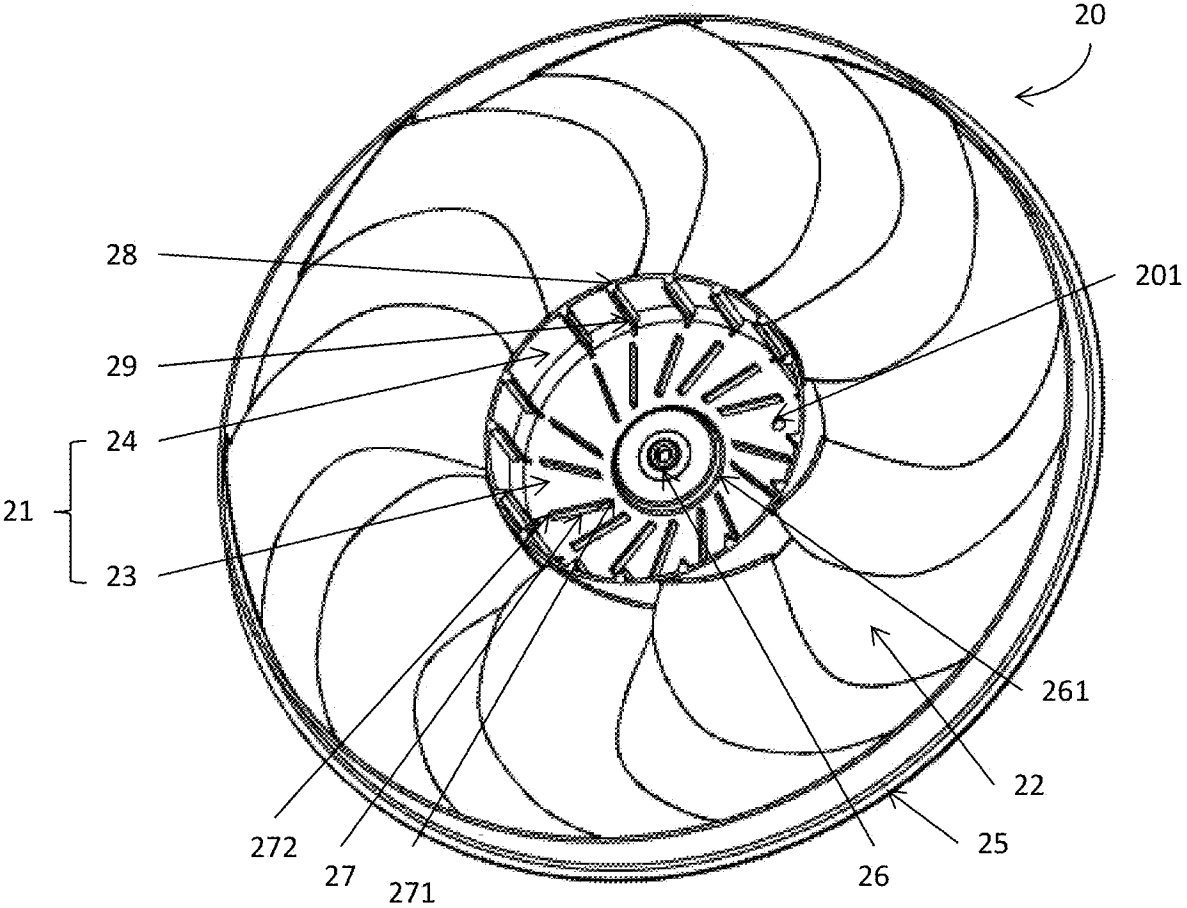
FIG. 2 illustrates more details of the part of the exemplary impeller assembly shown in FIG. 1 in some embodiments.

FIG. 2 illustrates more details of the part of the exemplary impeller assembly shown in FIG. 1 in some embodiments. More specifically, the part of the impeller assembly 20 shown in FIG. 2 includes a hub 21 that includes a top member 23 and a sidewall 24 in some embodiments. In some embodiments, the top member 23 and the sidewall 24 may be formed as a single, inseparable component via, for example, machining, pressing, stamping, etc. or may be formed into multiple, separable parts that are joined together via, for example mechanical means. In these embodiments, the hub 21 may further define an opening or a recessed area 26 to attach the impeller 20 to a power source or to a transmission mechanism that in turn operatively connects to a power source.

In various embodiments, the hub and/or other components of an impeller assembly are designed such that the impeller assembly is to have substantially uniformly distributed mass to rotate or spin around an axis to reduce stress on the shaft and other parts of the fan due to, for example, unbalanced mass distribution or unevenly distributed angular momentum. That is, due to the rotational or spinning nature of the impeller, many components such as the hub 21 and the outer rim 25 to which the ends of the blades are attached in the impeller assembly 20 are designed to have circular shapes to improve the distribution of the rotational moment of inertia along the angular direction so as to lower the stress or loading on the mechanism (e.g., an output shaft of a motor or a transmission mechanism). Nonetheless, absolutely uniform distribution of rotational moment of inertia may not necessarily be required.

For example, a blind or through aperture 201 of any shape of choice may be defined on the top member 23 as a design choice. Although the aperture 201 may reduce the rotational moment of inertia in the local region and thus present some adverse effects on, for example, the life of the output shaft to which the impeller 20 is attached, such features may nonetheless be permitted as long as various requirements (e.g., the difference in the rotational moment of inertia is less than a predetermined threshold, the stress level on the impeller or other parts connected to the impeller is less than a predetermined level, etc.) are satisfied.

The impeller 20 may also include a plurality of first ribs 27, each having a first end 271 and a second end 272 on the inner surface of the top member 23. A rib is a structural element that is either integrally and inseparably or separably formed on another structural element so as to reinforce the strength of the another structural element and may have various shapes and profiles. The first ribs may be separable or inseparable from the top member 23 and thus may be formed on the inner surface of the top member 23 by various manufacturing means including molding, machining, pressing, welding, brazing, gluing, sintering, co-sintering, or any other ways of joining one material to another material. That is, a first rib may be formed by machining (e.g., milling) the hub or may be installed onto the hub as a separate piece by, for example, molding, welding, brazing, sintering, co-sintering, embossing, press fitting, gluing, or any other methods of joining the first rib to the hub.

In some embodiments, all of the plurality of the first ribs 27 is formed by the same manufacturing process. In some embodiments, the plurality of the first ribs 27 may be formed by two or more different manufacturing processes. The total number of the plurality of first ribs may be determined based at least in part upon one or more weighted or non-weighted factors including, for example but not limited to, the operation requirement(s) of the impeller (e.g., the rotation or spinning speed, the driving power, etc.), the materials of components, the mechanical properties or requirements of the impeller assembly (e.g., the moment of inertia, the resonance frequency, the natural frequency of vibration of the impeller assembly or system, mechanical resonance, acoustic resonance, strength requirement(s), rigidity requirement(s), etc.), cost, manufacturability, reliability of one or more components or the entire impeller assembly, the design of other related component(s), etc. (collectively factors, structural characteristics, or simply characteristics) in some embodiments.

In some embodiments, the total number of the plurality of first ribs may be determined by using a sliding scale of a combination of the aforementioned factors. For example, a higher spinning speed impeller assembly with a predetermined driving power from the power source may benefit from a lower moment of inertia (or rotational moment) and thus a fewer number of first ribs, but at the same time the structural integrity or shear modulus (or modulus of rigidity) at a higher spinning speed may require or prefer more number of first ribs. In some embodiments, the total number of first ribs may be determined by using a pre-established look-up table that includes various properties or characteristics of various different designs having different numbers of first ribs under different operation conditions. In some other embodiments, the total number of first ribs may be determined analytically using, for example one or more physics models.

It shall be noted that although the first ribs illustrated in FIG. 2 comprise straight segments with the same or different cross-sectional profiles, the first plurality of first ribs may comprise one or more straight segments, one or more curvilinear segments, or any combinations thereof in various embodiments. That is, in the illustrative example shown in FIG. 2, the plurality of the first ribs 27 comprises a set of substantially straight segments. In some embodiments, the plurality of the first ribs 27 may comprise curved segments. Yet in some other embodiments, the plurality of the first ribs 27 may comprise a combination of one or more substantially straight segments and one or more curved segments. It shall be noted that the term "substantially" is used herein to refer to a feature that is intended or designed to be of certain characteristic such as a substantially straight first rib, but the manufacturing or design slacks, manufacturing tolerances, material movement or deformation due to various physical processes (e.g., material movement or deformation due to heat generated during the manufacturing process), or the normal wear and tear may nonetheless cause the feature to deviate from the intended profile or dimensions.

For example, a first rib may be designed to have a straight profile, but the manufacturing or design slacks, manufacturing tolerances, material movement or deformation due to various physical processes, or the normal wear and tear may nevertheless cause the produced profile of the first rib to deviate from the theoretical straightness in the design. Therefore, the first rib in this example is thus termed substantially straight to accommodate such deviations from theoretical or absolute straightness. The geometric profile, shape, or dimensions of a first rib may be determined based at least in part upon one or more factors including, for example but not limited to, the operation requirement(s) (e.g., the rotation or spinning speed, the direction of rotation or spinning, etc.), the mechanical requirement(s) (e.g., the resonance characteristics, the noise requirement, rigidity requirement, strength requirement, etc.), cost, manufacturability, any combination thereof, etc. in some embodiments.

The impeller 20 may also include a number of blades 22 that are separably or inseparably attached to the sidewall 24 of the hub 21 on one end and to the outer rim 25 on the other end. Each of the number of blades may have one or more different profiles including a planar surface, a three-dimensional curved surface, or any combinations thereof. The hub 21 may also include a plurality of second ribs along the inner surface of the sidewall of the hub 21 in some embodiments. In some embodiments where the space or configurations allow, at least some of the plurality of second ribs may also be separably or inseparably formed on the outer surface of the sidewall of the hub 21. Throughout this application, the term "sidewall" or a "surface" of the sidewall may refer to either the inner surface (close to the center of the hub) or the outer surface (away from the center of the hub) of the hub, unless otherwise specifically recited, claimed, or distinguished. A second rib may be formed by machining (e.g., milling) the hub or may be installed or attached onto the inner surface of the hub as a separate piece by, for example, welding, brazing, press fitting, gluing, or any other methods of joining the second rib to the inner surface of the hub. In some embodiments, all of the plurality of the second ribs are formed by the same manufacturing process. In some embodiments, the plurality of the second ribs may be formed by two or more different manufacturing processes.

The plurality of second ribs may be separably or inseparably attached to the inner sidewall 24 of the hub 21 in a substantially similar manner. A second rib may have a first end 28 at or near the end of the sidewall 24 and a second end at or near the inner surface of the top member 23. Therefore, the length of a second rib may span across the entire inner height (from the inner surface 24 of the top member 21 to the top edge of the sidewall 24) of the hub 21 in some embodiments, may be longer than the entire inner height of the hub 21 in some other embodiments, or may be shorter than the entire inner height of the hub 21 in yet some other embodiments.

A second rib may be located at about a location that may be determined by extending the tangent to the corresponding first rib 27 from the second end 272 to the inner surface of the sidewall of the hub in some embodiments. In some other embodiments, a second rib may be located at any other locations of choice on the inner surface of the sidewall of the hub. In some embodiments, the second end 29 extends to coincide with the surface on which the plurality of first ribs 27 lie. In some embodiments, the second end 29 of a second rib maintains a spacing value from the second end 272 of the corresponding first rib 27.

In some other embodiments, the second end 29 of a second rib coincides with the second end 272 of the corresponding first rib 27. The geometric profile, shape, or dimensions of a second rib may be determined based at least in part upon one or more factors including, for example but not limited to, the operation requirement(s) (e.g., the rotation or spinning speed, the direction of rotation or spinning, etc.), the mechanical requirement(s) (e.g., rigidity requirement, strength requirement, etc.), cost, manufacturability, any combination thereof, etc. in some embodiments.

Similar to the total number of the plurality of first ribs, the total number of the plurality of second ribs may be determined based at least in part upon one or more weighted or non-weighted factors including, for example but not limited to, the operation requirement(s) of the impeller (e.g., the rotation or spinning speed, the driving power, etc.), the materials of components, the mechanical properties or requirements of the impeller assembly (e.g., the moment of inertia, the resonance frequency, strength requirement(s), rigidity requirement(s), etc.), cost, manufacturability, reliability of one or more components or the entire impeller assembly, the design of other related component(s), etc. in some embodiments.

In some embodiments, the total number of the plurality of second ribs may be determined by using a sliding scale of a combination of the aforementioned factors. For example, a higher spinning speed impeller assembly with a predetermined driving power from the power source may benefit from a lower moment of inertia (or rotational moment) and thus a fewer number of second ribs, but at the same time the structural integrity or shear modulus (or modulus of rigidity) at a higher spinning speed may require or prefer more number of second ribs. In some embodiments, the total number of second ribs may be determined by using a pre-established look-up table that includes various properties or characteristics of various different designs having different numbers of second ribs under different operation conditions. In some other embodiments, the total number of second ribs may be determined analytically using, for example one or more physics models.

Figure 3:
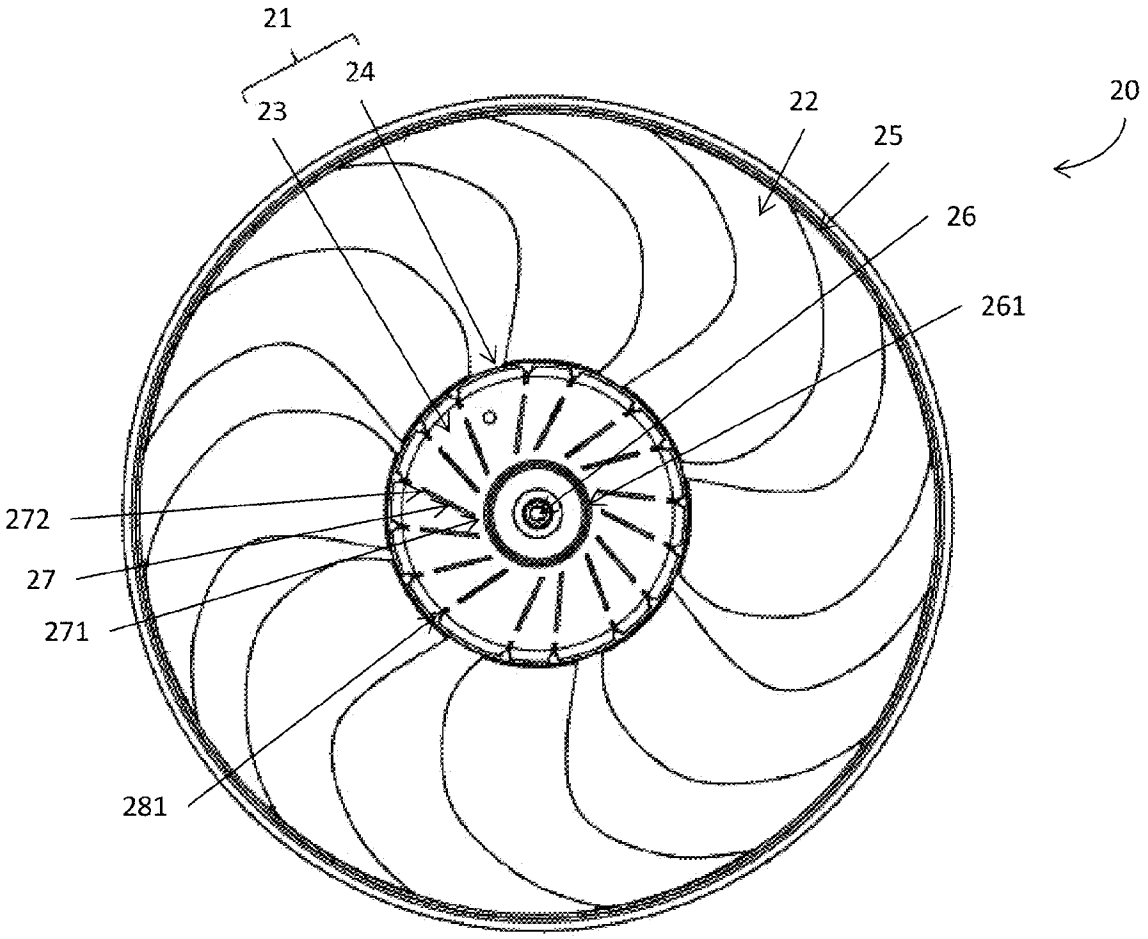
FIG. 3 illustrates a top view of the exemplary impeller assembly in some embodiments.

FIG. 3 illustrates a top view of the exemplary impeller assembly in some embodiments. As it can be seen from the top view of the exemplary impeller assembly, the first end 271 of a first rib on the inner surface of the top member 23 may be disconnected from the circular structural member 261 of the hub 21, and the second end 272 of the first rib may also be disconnected from the corresponding second rib (shown as 281) along the sidewall (24 in FIG. 2) in some embodiments. In these embodiments, the disconnection between a first rib 27 and the circular structural member 261 or the disconnection between the second end 272 of the first rib 27 may reduce the transfer of vibration from the power source and the number of blades 22 and thus effectively reduce the noise level.

For example, during coast down where the speed of the power source (e.g., a motor or an engine) is reduced from an operational speed to a complete stop, there may exhibit changes in the torque or output of the power source that may in turn cause vibration. Such changes may propagate to the number of blades or other parts of the impeller assembly and thus cause the undesired coast-down noise, especially when coupled with the natural frequency (or frequencies) of the impeller assembly 20 or one or more components thereof. Mechanical resonance is the tendency of a mechanical system to absorb more energy when the frequency of its oscillations matches the mechanical system's natural frequency of vibration than it does at other frequencies. Mechanical resonance may cause not only shortened life of one or more components of the mechanical system but also violent swaying motions and even catastrophic failure in improperly constructed structures. The disconnection between one or both ends of the first ribs and the corresponding component(s) or feature(s) on the first hub 21 has been demonstrated to effectively reduce the noise level during starting, operation, or coast-down of the impeller assembly in some embodiments.

Figure 4:
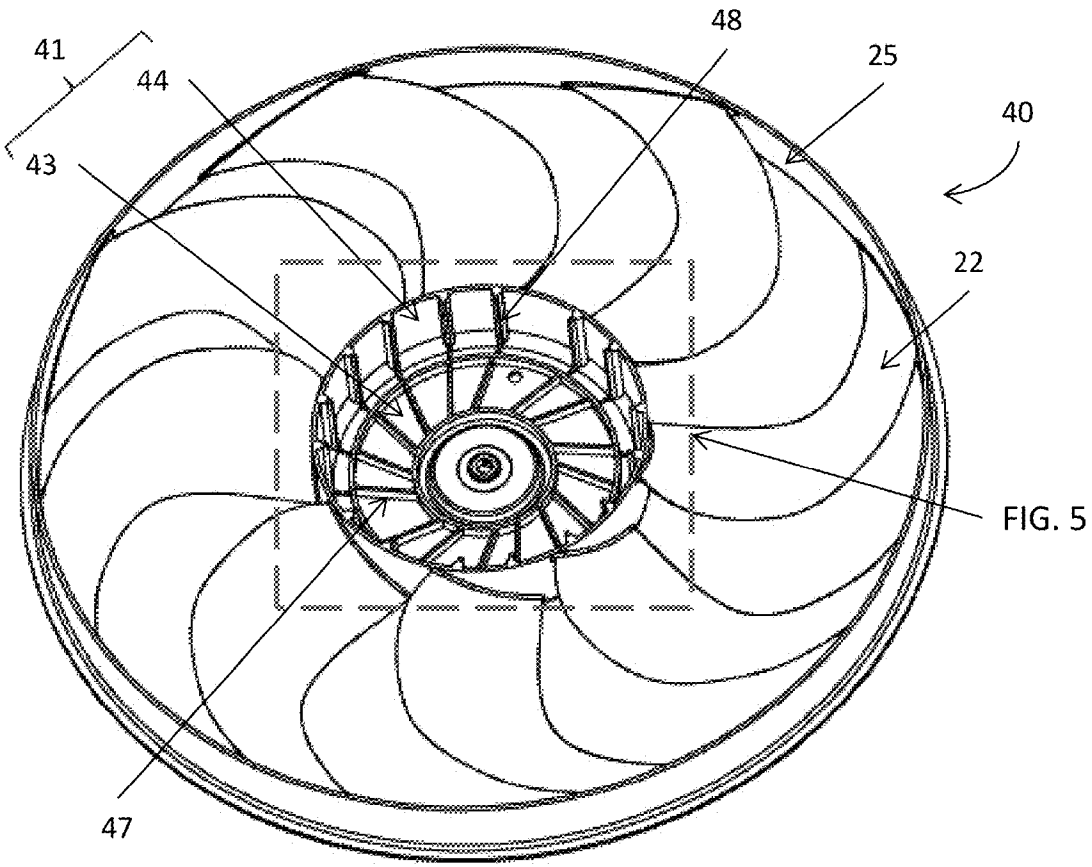
FIG. 4 illustrates a perspective view of a part of another exemplary impeller assembly in some embodiments.

FIG. 4 illustrates a perspective view of a part of another exemplary impeller assembly in some embodiments. More specifically, FIG. 4 illustrates a part of another exemplar impeller assembly 40 that includes a number of blades 22 and a hub 41. FIG. 4 similarly shows that the impeller assembly 40 also includes an outer rim 25 to which the ends of the blades 22 are attached. Nonetheless, it shall be noted that the outer rim 25 may be optional in other designs and is thus not intended to limit the scope of such other designs or the scope of the claims, unless otherwise specifically claimed or recited. The hub 41 of the part of the exemplary impeller assembly 40 may similarly comprise a top member 43 and a sidewall 44 that joins the top member 43 along the periphery of the top member 43.

The hub 41 in this exemplary impeller assembly 40 may also include a plurality of first ribs 47 on the inner surface of the top member 43 or a plurality of second ribs 48 along the inner surface of sidewall 44 in some embodiment. In some other embodiments where the space or configurations allow, at least some of the plurality of second ribs 48 may be separably or inseparably formed on the outer surface of the sidewall 44 in a substantially similar manner as that described for the plurality of first ribs of FIG. 2. More details about the rectangular area enclosed in dashed lines will be provided in the description for FIG. 5.

Figure 5:
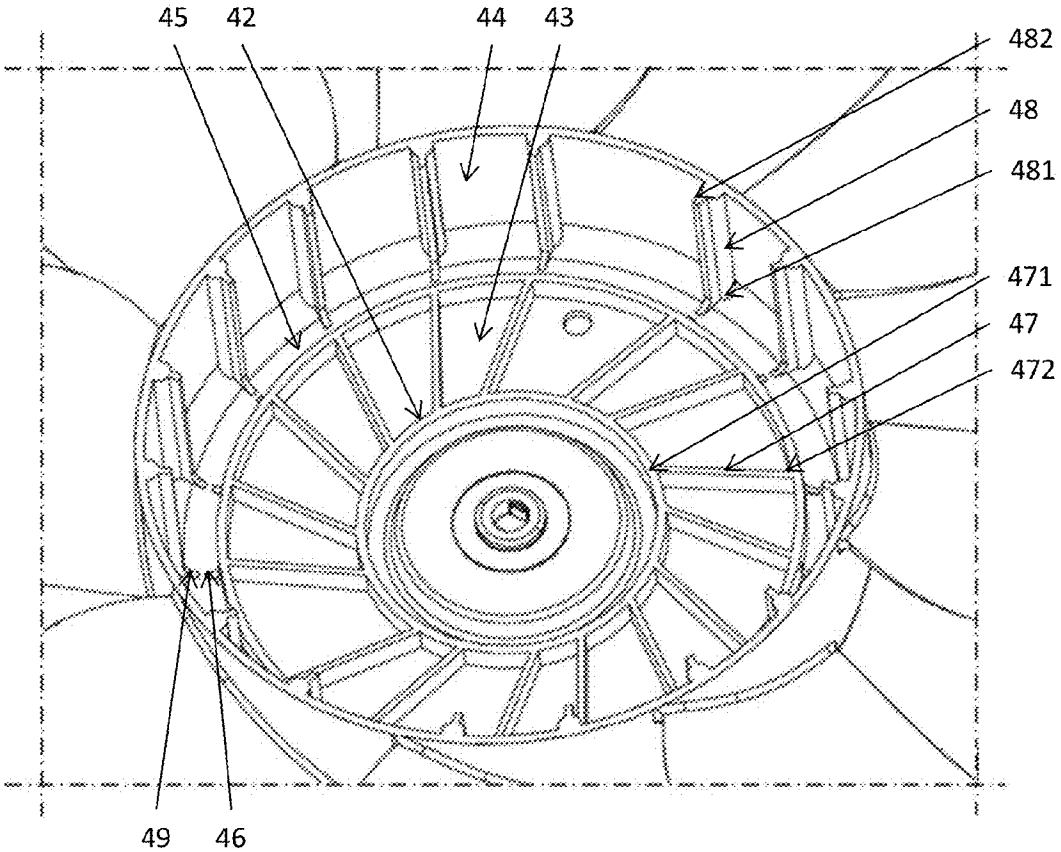
FIG. 5 illustrates a close-up view near the hub area of the exemplary impeller assembly shown in FIG. 4 in some embodiments.

FIG. 5 illustrates a close-up view near the hub area of the exemplary impeller assembly shown in FIG. 4 in some embodiments. More specifically, FIG. 5 illustrates more details about the area including the hub 41. In this exemplary impeller assembly shown in FIG. 5, the hub 41 may include a plurality of second ribs 48, each having a first end 481 and a second end 482 or a plurality of first ribs 47, each having a first end 471 and a second end 472. In the embodiments illustrated in FIG. 5, a second rib 48 is located along a line that extends from the corresponding first rib 47. In some other embodiments, a second rib may be located independent of the plurality of first ribs 47.

The cross-sectional profile of a first rib or a second rib 48 may be a design choice based at least in part upon one or more factors including, for example but not limited to, the rotational moment of inertia, the output of the power source, the operational requirements such as rotation or spinning speed, the cost, the ease or difficulty of manufacturing, flow rate requirements of the impeller, strength requirement, stress requirement, reliability requirement, noise requirement, or any combinations thereof, etc. The first end 481 of a second rib 48 may be at or near the top end of the hub 41, and the second end 482 of the second rib 48 may be at or near the inner surface of the top member 43 on which the plurality of first ribs 47 reside. Therefore, the length of a second rib may span across the entire inner height (from the inner surface of the top member 43 to the top edge of the sidewall 44) of the hub 41 in some embodiments, may be longer than the entire inner height of the hub 41 in some other embodiments, or may be shorter than the entire inner height of the hub 41 in yet some other embodiments.

In some embodiments, a second rib of the plurality of second ribs 48 may further include an outer extended feature 49 at the bottom or near the lower portion of the second rib. In some embodiments, a first rib of the plurality of first ribs 47 may further include an inner extended feature 46 at the bottom or near the lower portion of the first rib. The naming convention for the inner extended feature and the outer extended feature is used here relative to the center of the hub 41 to distinguish between these extended features.

In addition or in the alternative, the hub 41 may include an inner angular stiffener 42 in some embodiments. In addition or in the alternative, the hub 41 may include an outer angular stiffener 45 in some embodiments. In some of these embodiments, the height of the inner angular stiffener 42 or the height of the outer angular stiffener 45 may be identical to that of the first rib, as designed. In some other embodiments, the height of the inner angular stiffener 42 or the height of the outer angular stiffener 45 may be greater than or smaller than that of the first rib. The height of the inner angular stiffener 42 or the height of the outer angular stiffener 45 may be determined based at least in part upon one or more factors including, for example but not limited to, the rotational moment of inertia, the output of the power source, the operational requirements such as rotation or spinning speed, the cost, the ease or difficulty of manufacturing, flow rate requirements of the impeller, strength requirement, stress requirement, reliability requirement, noise requirement, or any combinations thereof, etc.

The dimensions (e.g., diameters, thickness, height, or profile, etc.) of the inner angular stiffener 42 or the outer angular stiffener 45 may be determined based at least in part upon one or more factors including, for example but not limited to, the rotational moment of inertia, the output of the power source, the operational requirements such as rotation or spinning speed, the cost, the ease or difficulty of manufacturing, flow rate requirements of the impeller, strength requirement, stress requirement, reliability requirement, noise requirement, or any combinations thereof, etc. For example, a thicker or taller inner (or outer) angular stiffener 42 may provide a higher, more favorable rigidity against bending but may in the meantime present a higher yet less favorable rotational moment of inertia, more obstruction or disturbance to air flow, or higher cost of manufacturing.

In some embodiments, the hub 41 may comprise only the inner angular stiffener 42 but not the outer angular stiffener 45. In some other embodiments, the hub 41 may comprise only the outer angular stiffener 45 but not the inner angular stiffener 42. In some other embodiments, the hub 41 may comprise both the inner angular stiffener 42 and the outer angular stiffener 45. In addition or in the alternative, the hub 41 may comprise the inner angular stiffener 42 that joins the first ends 471 such that the inner surface defined by the internal diameter constitutes a cylindrical surface as designed in some embodiments, although the inner surface as manufactured may deviate from a perfectly cylindrical surface. In some other embodiments, one or more first ends 471 may protrude beyond the inner surface defined by the internal diameter of the inner angular stiffener 43.

It shall be noted that the inner diameter surface comprises a substantially cylindrical surface in the embodiments described above, the cylindrical characteristic of the inner diameter surface is primarily to accommodate the rotational or spinning nature of the hub during operations of the impeller to provide substantially uniform angular distribution of the angular moment of inertia or the fluid flow within and around the hub. Nonetheless, the cylindrical characteristic of the inner diameter surface, as well the cylindrical nature of other features described in this application is not intended to preclude the addition of additional features or modification of the features already described herein in other embodiments. For example, the angular stiffener 42 or 45 may comprise one or more cutouts or openings having identical or different dimensions (e.g., width or height, etc.) as designed or one or more protrusions with identical or different dimensions (e.g., width, length, or thickness, etc.) as designed. That is, the inner angular stiffener (e.g., reference numeral 42) or the outer angular stiffener (e.g., reference numeral 45) may comprises one or more cutouts some of which may span across the entire height of the inner angular stiffener or the outer angular stiffener so as to divide the inner angular stiffener or the outer angular stiffener into multiple, discrete arcuate segments in some embodiments. The size(s) and location(s) of the one or more cutouts or openings may be determined based at least in part upon one or more factors including, for example but not limited to, specific design configurations, various requirements on the mechanical properties (e.g., strength, rigidity, etc.) of the impeller, operation conditions or requirements (e.g., output power of the power source, fluid flow requirements, etc.), any combinations thereof, etc.

In addition or in the alternative, the height dimensions of the inner angular stiffener and the outer angular stiffener may be determined based at least in part upon one or more weighted or non-weighted factors including, for example but not limited to, the operation requirement(s) of the impeller (e.g., the rotation or spinning speed, the driving power of the power source, etc.), various materials of components, the mechanical properties or requirements of the impeller assembly (e.g., angular moment of inertia, the resonance frequencies, natural frequencies of vibration of the impeller assembly or system, mechanical resonance, acoustic resonance, strength requirement(s), rigidity requirement(s), etc.), cost, manufacturability, reliability of one or more components or the entire impeller assembly, the design of other related component(s), and fluid flow requirement(s) (e.g., flow field, flow rate, etc.), etc. in some embodiments. That is, the height dimensions of the inner and outer angular stiffeners may be identical or different in different embodiments and may be determined based at least in part upon one or more weighted or non-weighted factors or on one or more sliding scales of one or more or factors listed above. In some embodiments, the dimensions may be determined by using computer simulations or design of experiments (DOE) with or without interpolation or extrapolation.

In the exemplary impellers illustrated in FIGS. 1-7, the thicknesses of various structural members range from 2 mm to 12 mm; the hub outside diameters range from 70 mm to 420 mm; the outside diameters of the outer angular stiffeners range from 60 mm to 360 mm; the outside diameters of the inner angular stiffeners range from 30 mm to 200 mm; the heights of the hub range from 15 mm to 90 mm; the heights of the outer angular stiffeners range from 2 mm to 40 mm; and the heights of the inner angular stiffeners range from 2 mm to 20 mm. In the specific exemplary embodiments shown in FIGS. 7A-B, the outside diameter of the hub is 140 mm; the thickness of the sidewall of the hub and the outer angular stiffener is 2.5 mm; the outside diameter of the outer angular stiffener is 124 mm; the heights of the hub and the outer angular stiffener are 39 mm and 15 mm, respectively.

It shall be noted that the dimensions provided herein represent the dimensions used in the exemplary implementations or analyzed based at least in part upon the configurations as shown in the illustrated embodiments. Nonetheless, it shall be noted that one of ordinary skill in the art will clearly understand that specific dimensions or configurations of impeller designs may be different from the illustrated implementations, and that the dimensions and configurations provided herein are thus not intended to limit the scope of other embodiments or implementations or the scope of the claims, unless otherwise specifically claimed or recited. It shall also be noted that although the height of the hub and the height of the outer angular stiffener currently exhibit a ratio of 2.6 (39:15), and the height of the outer angular stiffener is shorter than that of the hub in the exemplary implementations illustrated in FIGS. 7A-B and described in the ranges in the preceding paragraphs, the outer angular stiffener does not necessarily need to be shorter than the hub in some other embodiments. Rather, the height of the outer angular stiffener may be identical to or even longer than that of the hub in some embodiments, if the design configurations so require or desire in these embodiments.

In some other embodiments, the hub 41 may comprise only the inner angular stiffener 42 joining the inner portions of the respective first ribs close to the first ends 471 of the plurality of first ribs 47. In some other embodiments, the inner angular stiffener 42 may join the plurality of first ribs 47 at the inner ends 471 such that the surface 421 defined by the inner diameter forms a substantially cylindrical surface without any protrusions from the plurality of first ribs 47. In some embodiments, the inner angular stiffener 42 may join the plurality of first ribs 47 at locations close but not exactly at the inner ends 471 such that the surface 421 defined by the inner diameter forms a substantially cylindrical surface having some protrusions from the plurality of first ribs 47.

In some other embodiments, the outer angular stiffener 45 may join the plurality of first ribs 47 at the second ends 472 such that the outer surface defined by the outer diameter of the outer angular stiffener 45 forms a substantially cylindrical surface as designed without any protrusions from the plurality of first ribs 47, although the outer surface as manufactured may deviate from a perfect cylindrical surface. In some embodiments, the outer angular stiffener 45 may join the plurality of first ribs 47 at locations close to but not exactly at the outer ends 472 such that the outer surface defined by the outer diameter forms a substantially cylindrical surface having some protrusions 46 from the plurality of first ribs 47.

The side-view of the extended feature 49 or the inner extended feature 46 (or the protrusions) may comprise a rectangular shape, a triangular shape, a rectangular shape with one or more curved edges, or a triangular shape with one or more curved edges in some embodiments and may be determined based at least in part upon one or more factors including, for example but not limited to, one or more requirements of strength, rigidity, rotational moment of inertia, stress, flow rate, ease of manufacturing, cost, or any combinations thereof, etc. The inner angular stiffener 42 or the outer angular stiffener 45 may be separably or inseparably formed on the inner surface of the top member 43 of the hub 41 by, for example, various manufacturing means including molding, machining, pressing, welding, brazing, gluing, sintering, co-sintering, or any other ways of joining one material to another material.

In some embodiments, the hub 41 may comprise a plurality of inner extended features 46 that correspond to at least some of the plurality of first ribs 47 in an axisymmetric manner along outer diameter surface of the outer angular stiffener 45, where each of the plurality of extended features 46 may be formed as an inseparable feature or a separable feature of the hub or the corresponding first rib to contact both the outer diameter surface of the outer angular stiffener 45 and the surface 43. For example, an extended feature 46 may be formed as an inseparable part of the hub 41 by, for example machining, molding, welding, any other manufacturing processes for joining materials together, or a combination thereof in some embodiments. In some other embodiments, an extended feature 46 may be formed as a part of a corresponding first rib 47 which is then joined or assembled onto the hub 41 such that the extended feature 46 extends beyond the outer diameter surface of the outer angular stiffener 45.

In some other embodiments, an extended feature 46 may be formed as a separable or an inseparable part of the hub 41. An extended feature 46 may contact the inner surface of the top member 43 or the outer diameter surface of the outer angular stiffener 45 to enhance the structural integrity or rigidity of the hub 41 against deformation in one or more directions in some embodiments. In these embodiments, the manner of a feature 46 joining the inner surface of the top member 43 of the hub 41 or the outer diameter surface of the outer angular stiffener 45 depends on how the extended feature 46 is formed with respect to the hub 41 or with respect to the corresponding first rib 47.

In some embodiments, the height of an extended feature 46 may be the same height as or may be shorter than that of the outer angular stiffener 45. The side view of an extended feature 46 may be of a polygonal shape having all straight edges in some embodiments or having one or more curved edges in some other embodiments. The shape or dimensions of an extended feature 46 may be determined based at least in part upon one or more factors including the ease or cost of manufacturing process(es), the moment of inertia, available design estate for feature 46 or other neighboring feature(s), robustness or reliability of the design, the output of the driving source (e.g., a motor or an engine), any combination thereof, etc.

Figure 6:
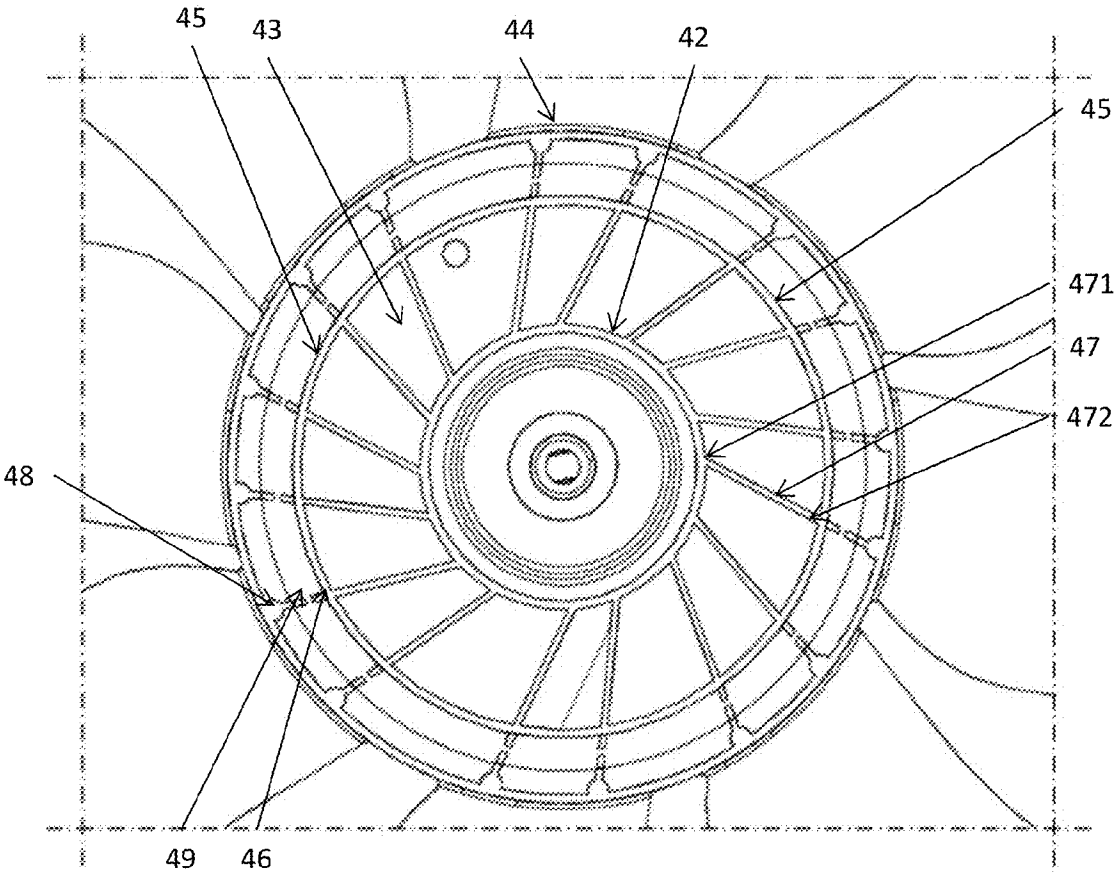
FIG. 6 illustrates a top view of the hub area of the exemplary impeller assembly shown in FIG. 5 in some embodiments.

FIG. 6 illustrates a top view of the hub area of the exemplary impeller assembly shown in FIG. 5 in some embodiments. In some embodiments, the inner extended features 46 may be formed as a part of their corresponding first ribs 47 or as a part of the inner angular stiffener 42. In some embodiments, the outer extended features 49 may be formed as a part of their corresponding second ribs 48 or as a part of the outer angular stiffener 45. As it can be seen from the exemplary impeller assembly 40 illustrated in FIG. 6, the exemplary impeller assembly 41 includes both the inner angular stiffener 42 and the outer angular stiffener 45, and the plurality of inner extended features 46 are disjoint from their corresponding outer extended features 49 in this exemplary configuration. One of the advantages of having the plurality of first ribs 47 disjoint from the plurality of second ribs 48 is to interrupt the transfer of power (e.g., torque) or vibration between the power source (e.g., a motor or an engine) and the number of blades such that the noise level of the exemplary impeller assembly or other similarly designed impeller during starting, operation, or coast down may be reduced while maintaining substantially similar level of stress or substantially similar flow rate. The effectiveness of some exemplary implementations of impeller assembly will be described with reference to FIGS. 8, 9A-D, and 10A-B.

Figure 7A:
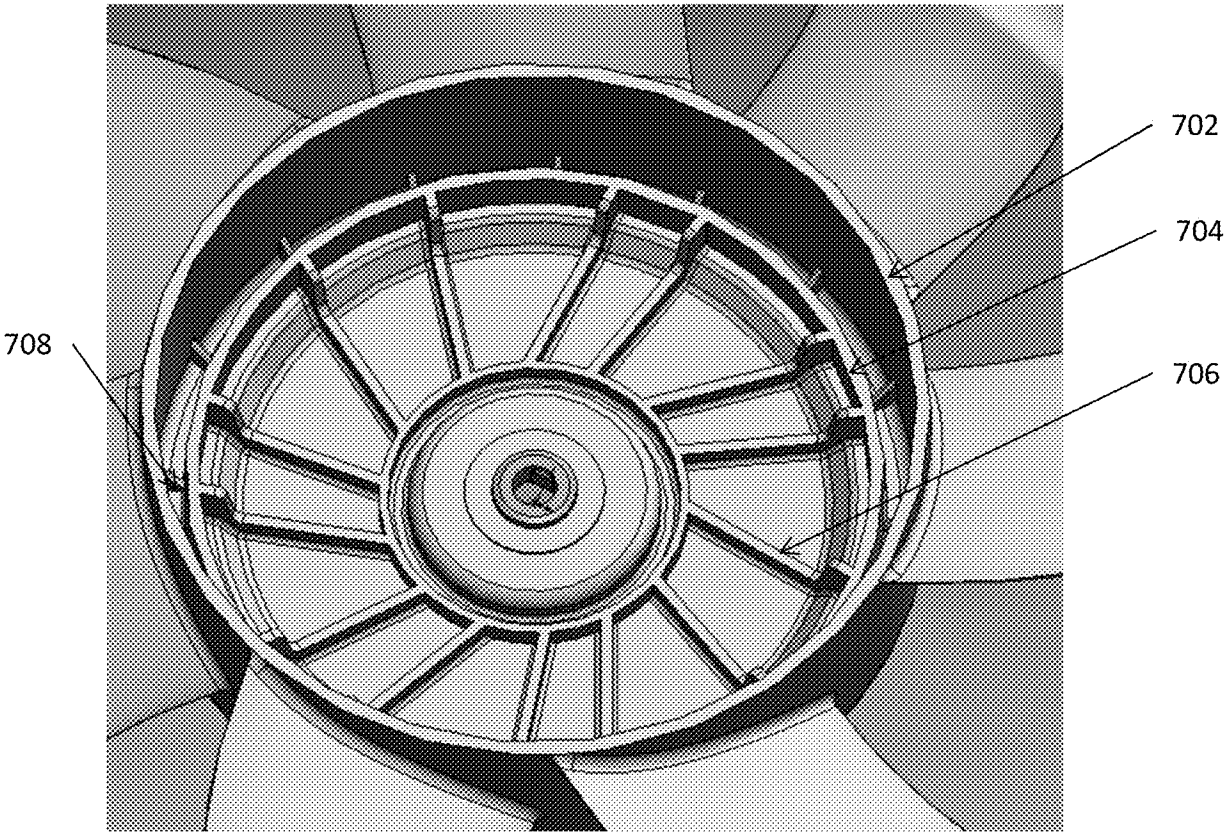
FIG. 7A illustrates a perspective view of a design model of an exemplary impeller in some embodiments.

FIG. 7A illustrates a perspective view of a design model of an exemplary impeller in some embodiments. More specifically, FIG. 7A illustrates a part of an exemplary impeller having a first cylindrical portion 702 that also serves as the sidewall of the hub and a second cylindrical portion 704 to which a plurality of first ribs 706 are separable or inseparably attached. FIG. 7A further illustrates that the hub also includes a plurality of second ribs 708, which is better illustrated in FIG. 7B.

Figure 7B:
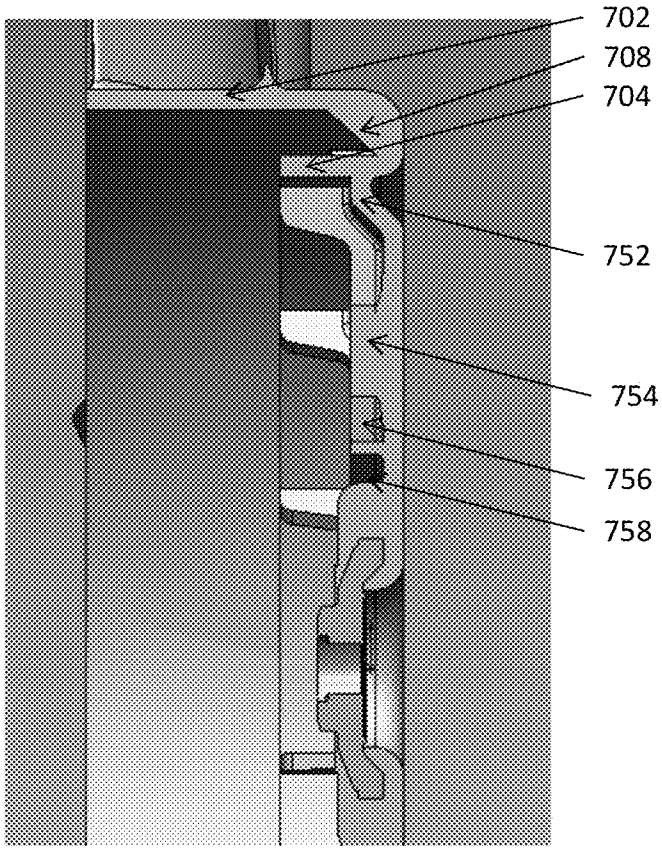
FIG. 7B illustrates a cross-section view of the design model of an exemplary impeller shown in FIG. 7A in some embodiments.

FIG. 7B illustrates a cross-section view of the design model of an exemplary impeller assembly shown in FIG. 7A in some embodiments. FIG. 7B shows that the hub of the exemplary impeller assembly includes a first cylindrical portion 702 and a second cylindrical portion 704. Moreover, the exemplary impeller assembly shown in FIG. 7B includes a plurality of second ribs 708 each of which, as shown in FIG. 7B, comprises a triangular piece of material that is separably or inseparably formed on the first cylindrical portion 702 and the inner surface of the hub. It shall be noted that although the plurality of second ribs 708 appear to join the second cylindrical portion 704 and does not extend along the interior surface of the first cylindrical surface 702 in the illustrated exemplary impeller assembly, the joining between the plurality of second ribs 708 and the external surface of the second cylindrical portion 704 or the absence of extension of the plurality of second ribs 708 along the internal surface of the first cylindrical portion 702 shall not be considered as limiting the scope of various other embodiments or the scope of the claims, unless otherwise specifically claimed or recited.

It shall also be noted that each of the plurality of second ribs 708 appear to have a triangular shape with a straight edge between the first cylindrical portion 702 and the second cylindrical portion 704. Nonetheless, the exhibition of a straight edge in the shape of the second rib illustrated in FIG. 7B is not intended to limit the scope of other embodiments or the scope of the claims, unless other specifically recited or claimed. Rather, the shape of a second rib may constitute a design choice based at least in part upon one or more factors including, for example but not limited to, the rotational moment of inertia, the output of the power source, the operational requirements such as rotation or spinning speed, the cost, the ease or difficulty of manufacturing, flow rate requirements of the impeller, strength requirement, stress requirement, reliability requirement, noise requirement, or any combinations thereof, etc. In addition, FIG. 7B shows various other features (752, 754, 756, and 758) that constitute a design choice for the particular, exemplary implementation illustrated in FIG. 7B and thus may or may not exist in other implementations or embodiments having different configurations or design choices.

Figure 8:
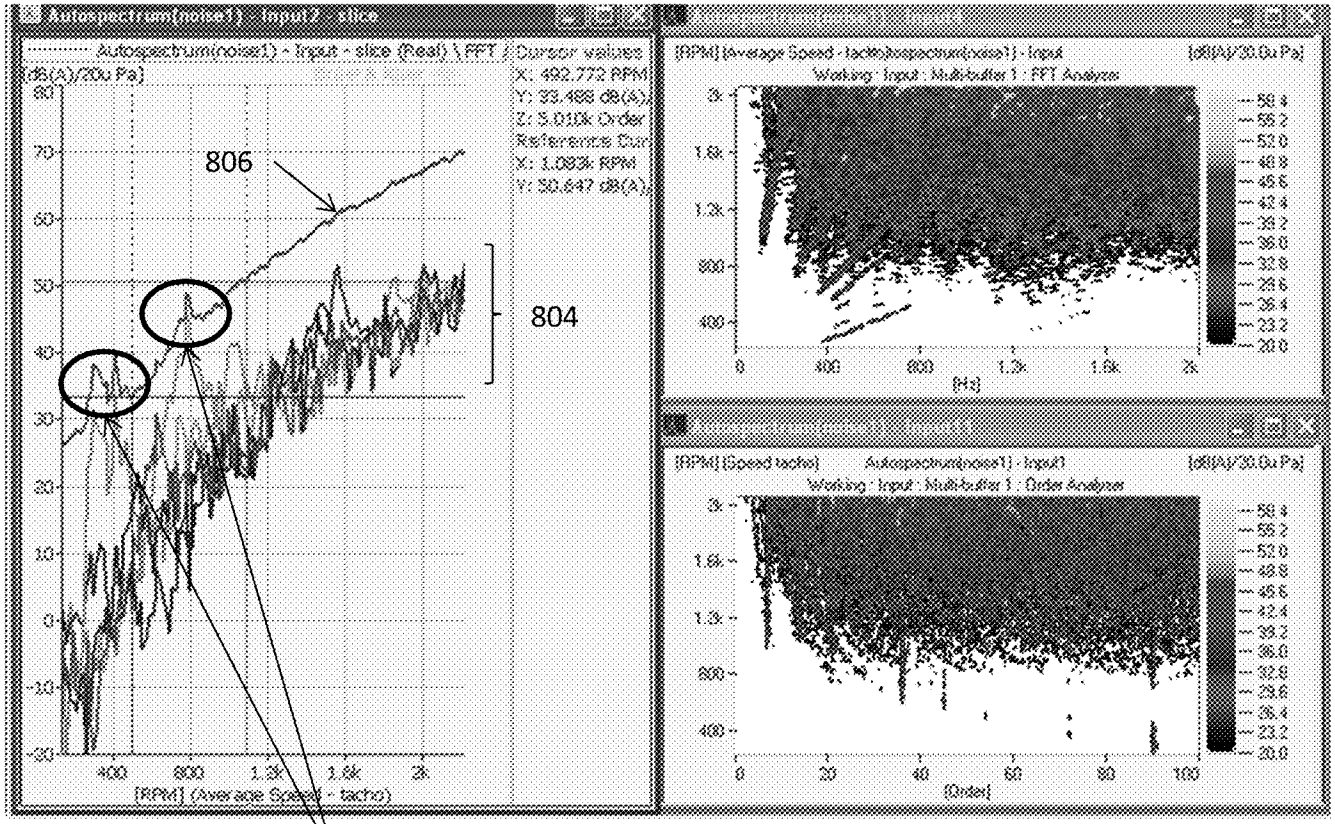
FIG. 8 illustrates some exemplary noise analysis results of an exemplary benchmark impeller in some embodiments.

FIG. 8 illustrates some exemplary noise analysis results of an exemplary benchmark impeller in some embodiments. More specifically, FIG. 8 shows, in the upper right-hand window, the fast Fourier transform analysis results with the impeller's rotational or spinning speed (in revolutions per minute or RPM) as the vertical axis and the natural frequencies (in Hertz) as the horizontal axis. FIG. 8 further illustrates, in the lower right-hand window, the order analysis results with the impeller's rotational or spinning speed (in revolutions per minute or RPM) as the vertical axis and the orders as the horizontal axis.

FIG. 8 also shows, in the left-hand window, the noise analysis results with the noise level (in dB) as the vertical axis and the impeller's rotational or spinning speed (in revolutions per minute or RPM) as the horizontal axis. In the left-hand window, the bundles of line plots 804 represent the 18-order, the 36-order, the 45-order, the 54-order, and the 90-order line plots derived from the plots on the right-hand windows. 806 in FIG. 8 illustrates the line plots of the total noise profile that exhibits two spikes or two groups of spikes 802 that represent the coast-down noise levels when the power source of the impeller assembly ramps down from some operational speed to a complete stop.

Figure 9A:
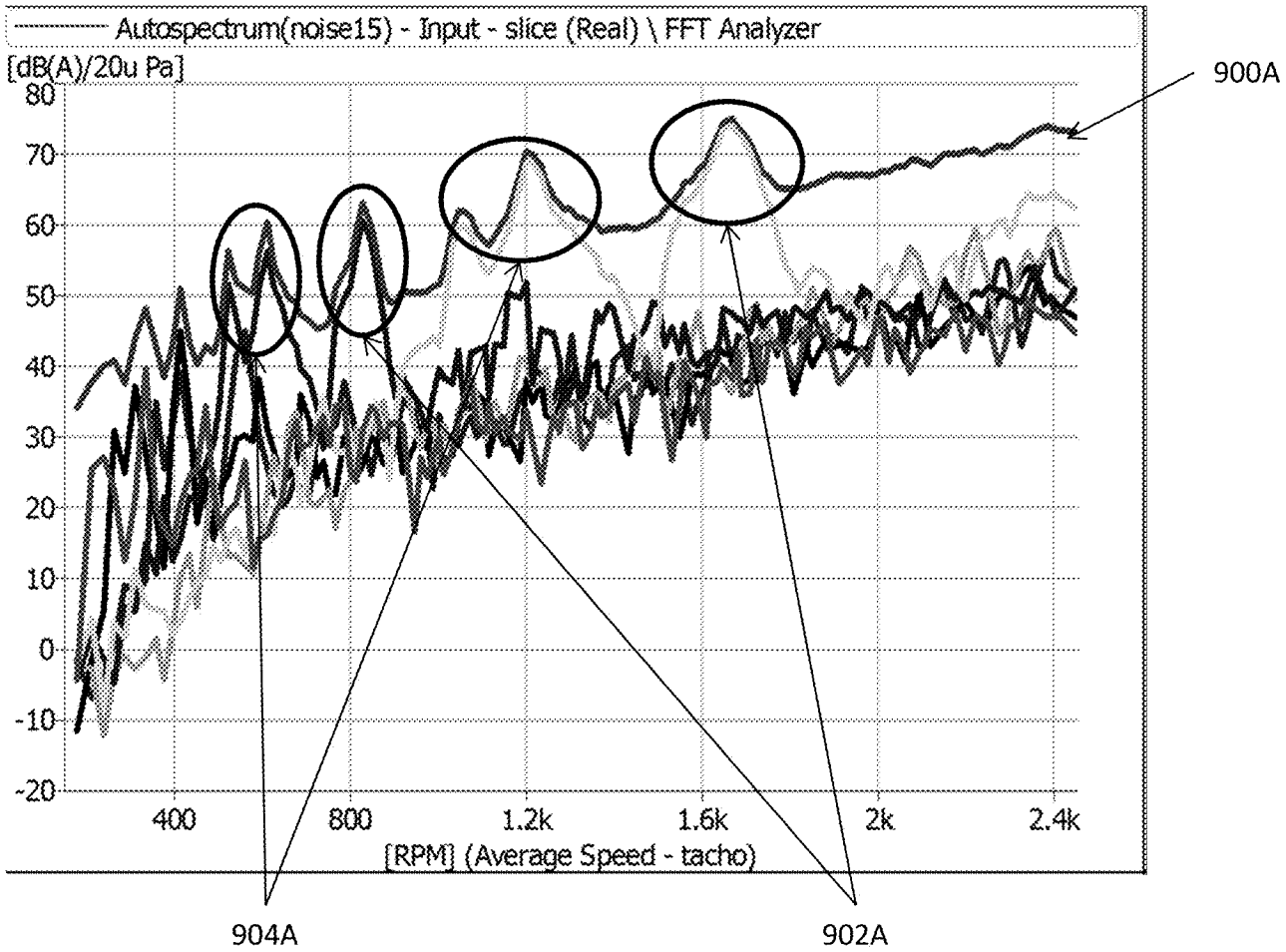
FIGS. 9A-C illustrate some exemplary noise analysis results of some exemplary impellers described herein in some embodiment.
Figure 9B:
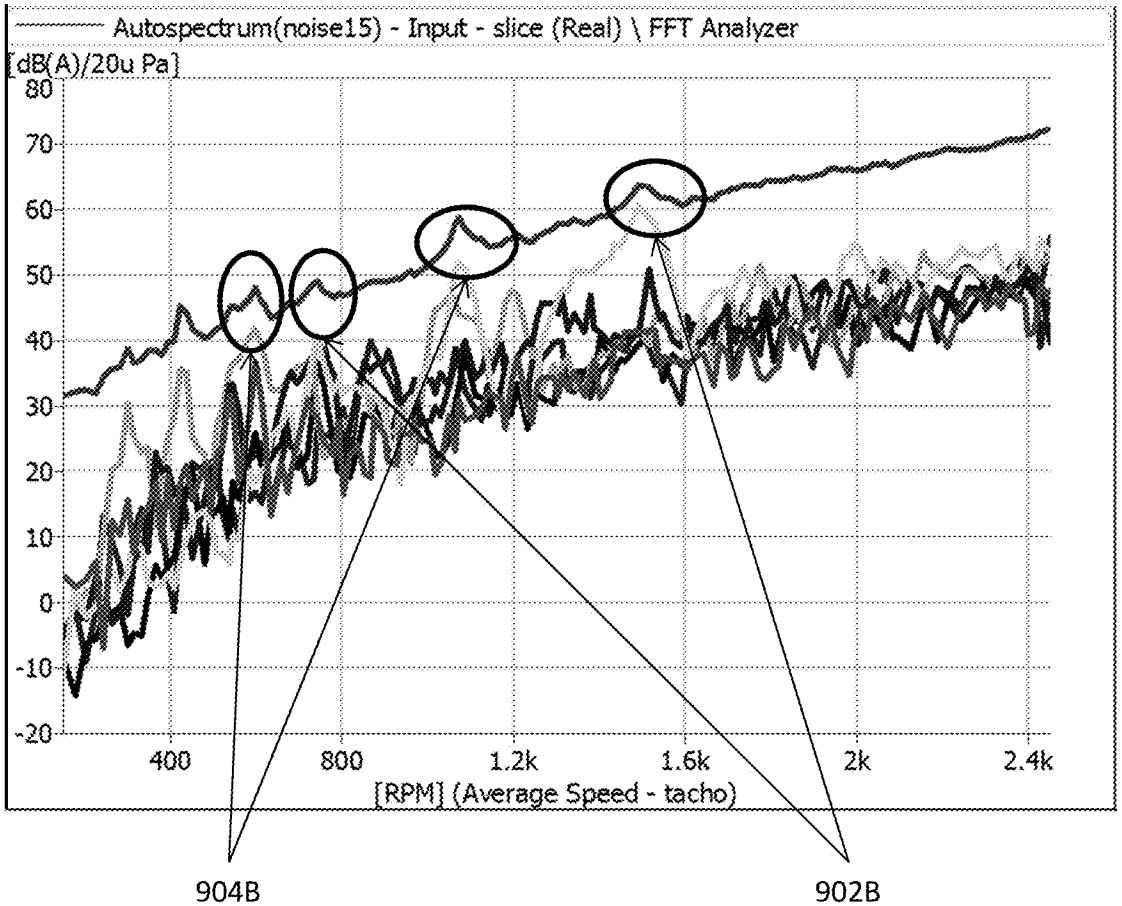
Figure 9C:
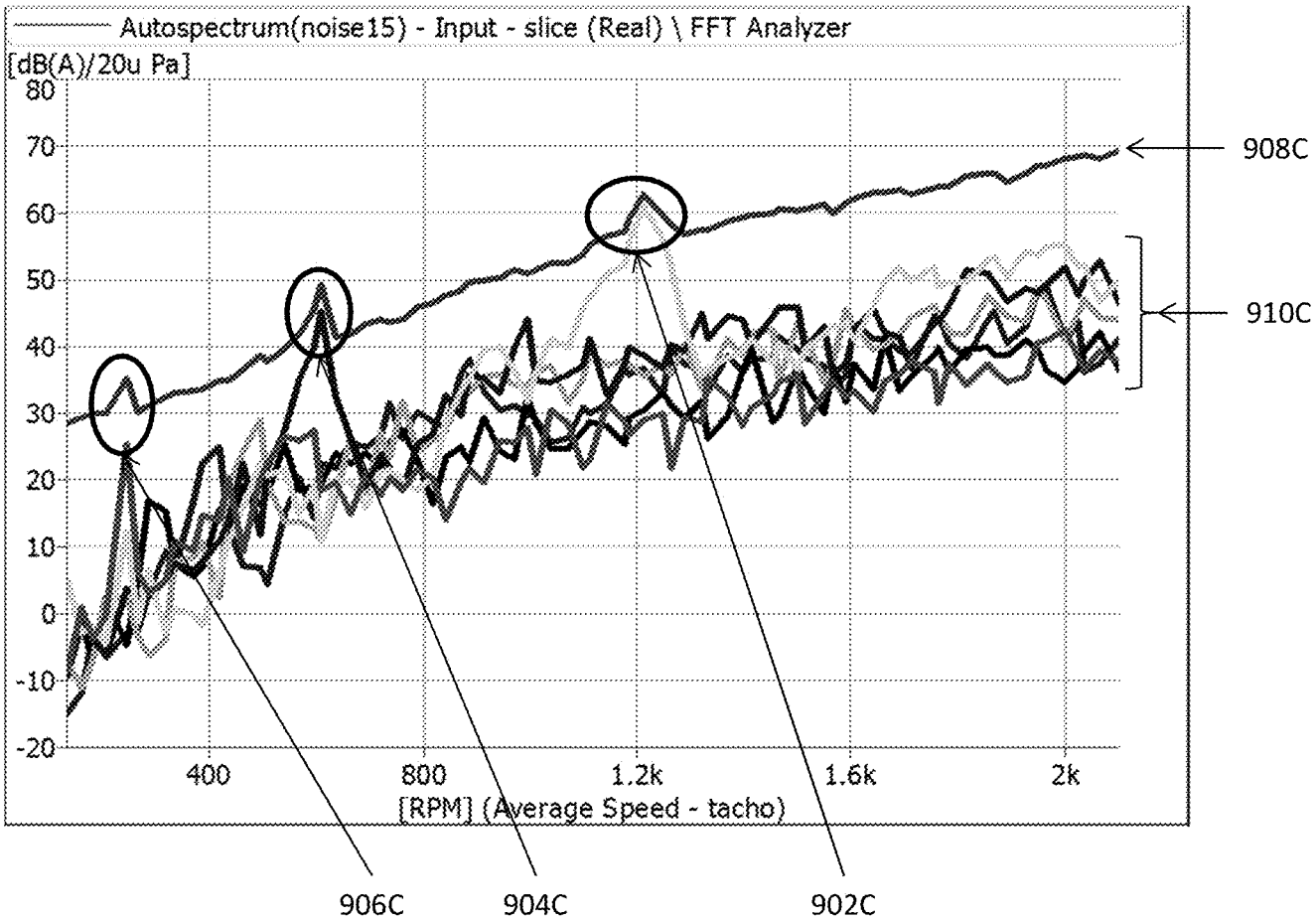

FIGS. 9A-C illustrate some exemplary noise analysis results of some exemplary impellers described herein in some embodiment. More specifically, FIG. 9A illustrates a similar line plots of a fast Fourier transform analysis in which line plot 900A illustrates the total noise profile for a traditional impeller for benchmark purposes. FIG. 9A illustrates that there exist multiple spikes for the noise at 470 Hz (902A) as well as 360 Hz (904A) along 900A. FIG. 9B illustrates a similar line plots of the same fast Fourier transform analysis of a first embodiment such as the impeller assembly described in FIGS. 1-3.

More specifically, FIG. 9B demonstrates that the noise levels at both the 470 Hz (902B) and the 360 Hz (904B) have been reduced when compared with the traditional impeller illustrated in FIG. 9A. FIG. 9C a similar line plots of the same fast Fourier transform analysis of a first embodiment such as the impeller assembly described in FIGS. 7A-B. More specifically, FIG. 9C demonstrates that the noise levels 902C, 904C, and 906C along the total noise profile 908C, which includes the summation of the noise profiles of individual orders 910C, have been further reduced when compared with the traditional impeller illustrated in FIG. 9A. In the exemplary models for which FIGS. 9B-C are generated, these exemplary impellers greatly reduce the peak level of noise by about 8 dB(A) when compared with the benchmark impeller assembly shown in FIG. 9A.

Figure 9D:
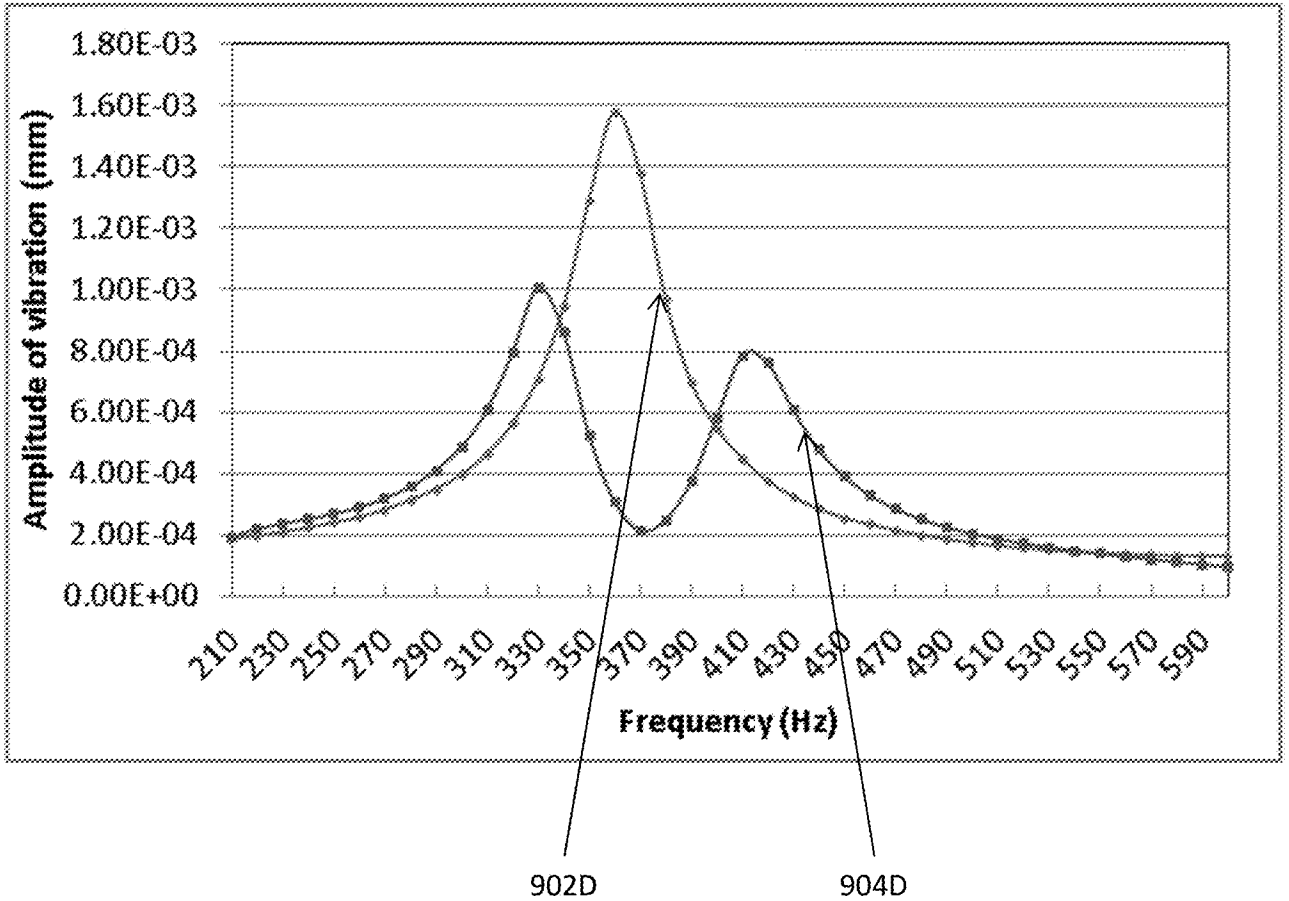
FIG. 9D illustrates a comparison of harmonic response frequency analysis results between a benchmark impeller and one exemplary impeller in some embodiment.

FIG. 9D illustrates a comparison of harmonic response frequency analysis results between a benchmark impeller and one exemplary impeller in some embodiment. More specifically, FIG. 9D illustrates the results of a harmonic response frequency analysis where 902D illustrates the results of a traditional impeller assembly as that for the analysis done in FIG. 9A, and 904D illustrates the results of an exemplary impeller assembly as described herein with reference to either one of FIG. 1-6 or 7A-B. As FIG. 9D shows, disconnecting the first ribs from the sidewall of the hub effectively reduces the transfer of force or vibration between the motor and the blades and thus leads to a lower level of noise within a range from 300 Hz to 480 Hz that is related to the coast down noise.

Figure 10B:
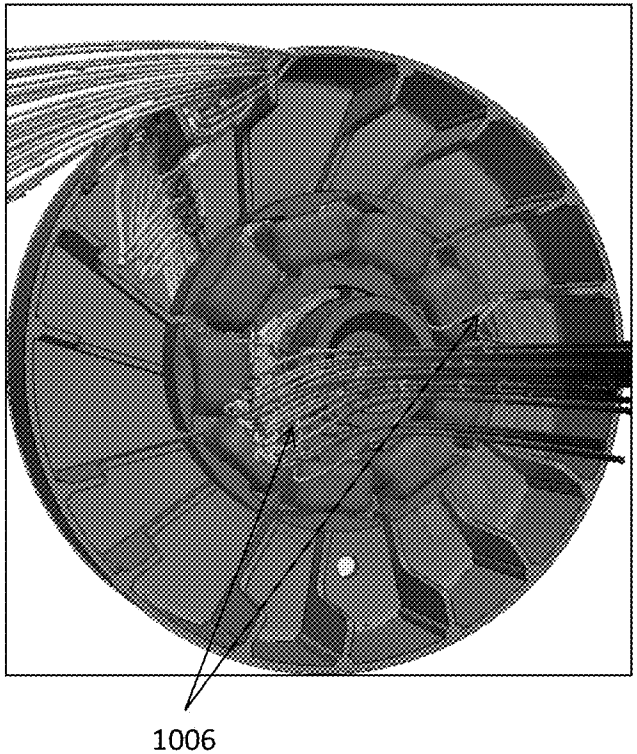
FIGS. 10A-B illustrate fluid flow analysis results in some embodiments.
Figure 10A:
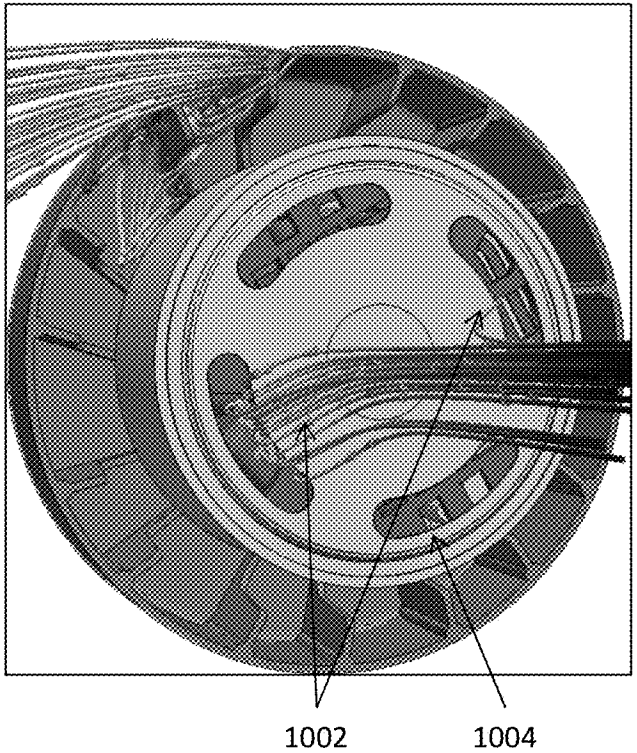

FIGS. 10A-B illustrate fluid flow analysis results in some embodiments. More specifically, FIG. 10A illustrates simulated fluid flow field of some benchmark impeller assembly in order to estimate the impact on the flow rate through the power source. FIG. 10A illustrates the fluid flow field 1002 outside the housing 1004 of the power source, and FIG. 10B illustrates the fluid flow field 1006 both inside and outside the housing 1004 of the power source. The same fluid flow analysis is performed on various exemplary impeller assemblies as described herein and shows less than three percent variations in flow rate ($m^3$/hour) for various embodiments described herein under the same conditions when compared with the benchmark impeller assembly as shown in FIGS. 10A-B.

In addition to the fluid flow analysis using computational fluid dynamics simulation engines, various embodiments also exhibit about 15% variations in the maximum tensile stress levels between the benchmark impeller assembly and various embodiments described herein under the same loading or operation conditions. Therefore, the impellers as described in various embodiments maintain substantially similar levels of maximum tensile stress and flow rates through the power source, while greatly reducing the noise level of the impeller.

Figure 11A:
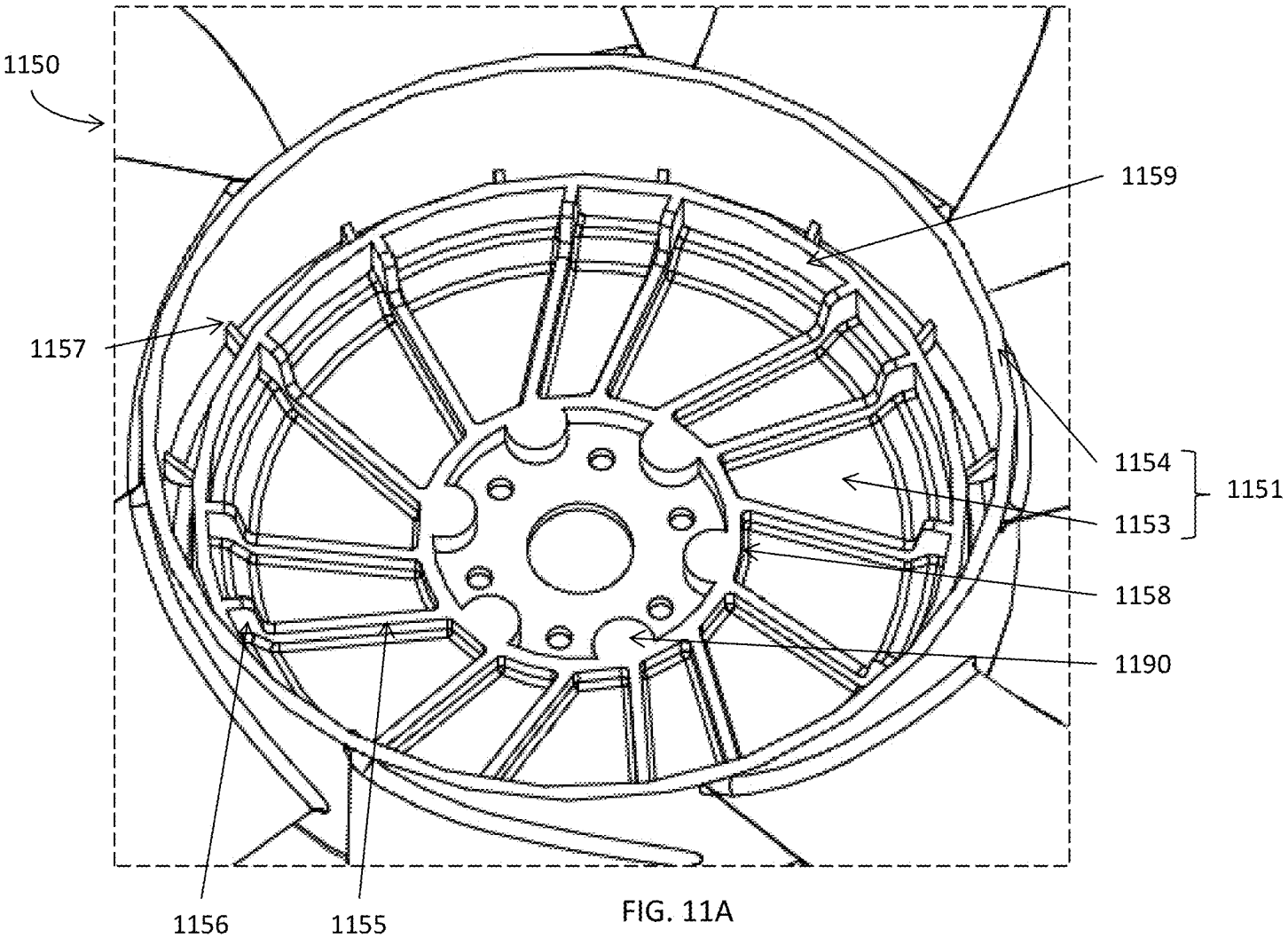
FIG. 11A illustrates a perspective view of a part of an exemplary impeller in some embodiments.
Figure 11B:
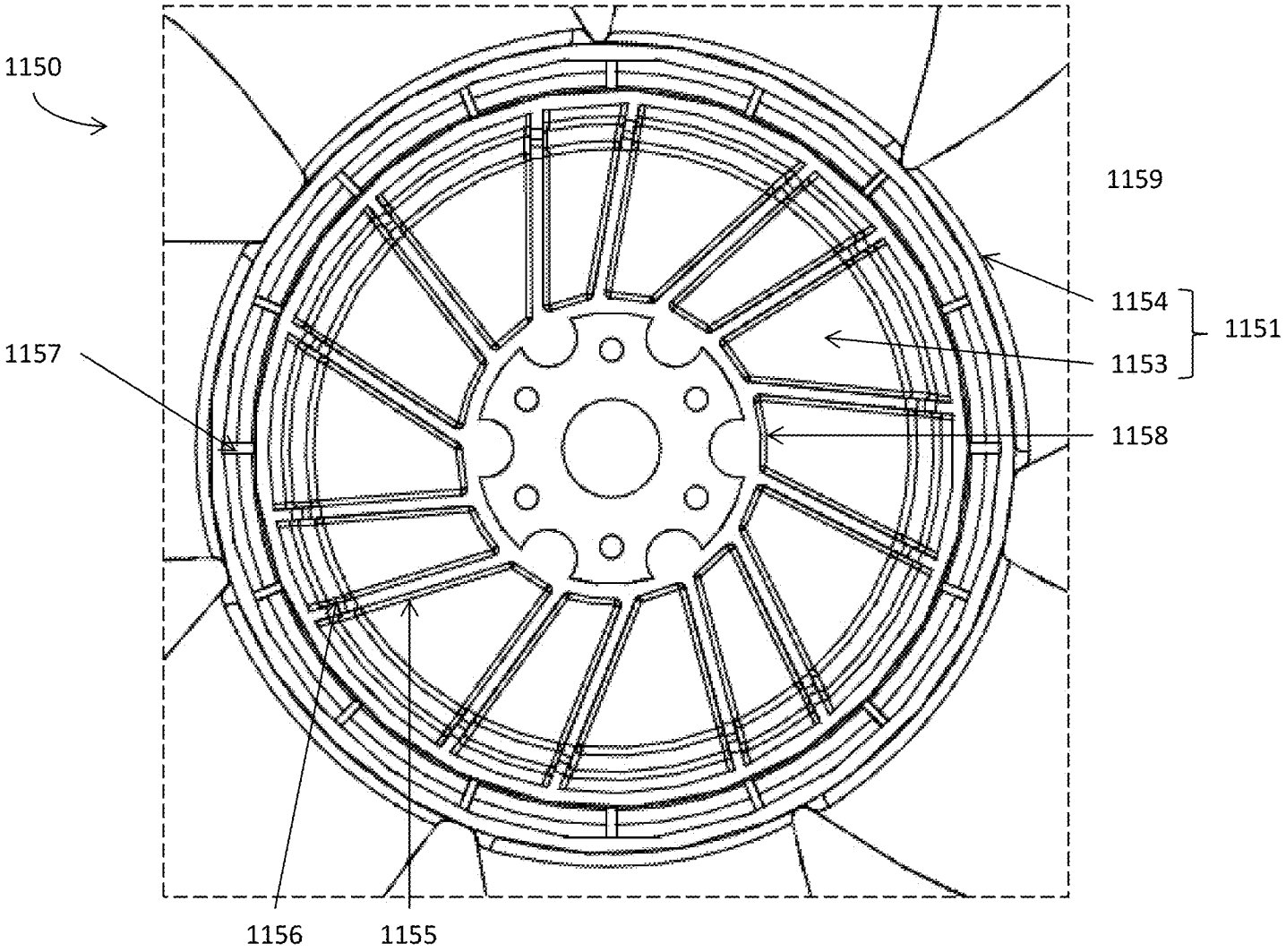
FIG. 11B illustrates the bottom view of the part of the exemplary impeller assembly shown in FIG. 11A in some embodiments.

FIG. 11A illustrates a perspective view of a part of an exemplary impeller in some embodiments. More specifically, FIG. 11A illustrates the perspective view of an exemplary impeller 1150, and FIG. 11B illustrates the bottom view of the part of the exemplary impeller assembly shown in FIG. 11A in some embodiments. This particular exemplary impeller is similar to those described previously with reference to FIGS. 1-7, and thus only the differences will be described herein without unnecessary repetitions or duplications. In these illustrated embodiments, the hub 1151 comprises a sidewall 1154 that is separably or inseparably formed with the top member 1153 of the hub 1151.

The hub further comprises a plurality of first radial stiffeners 1155 that extend radially outward in the exemplary hub, even though the first radial stiffeners 1155 may or may not necessarily extend radially outward from the center of the hub. That is, the imaginary extension lines extending from each of the plurality of first radial stiffeners 1155 may or may not necessarily coincide with the center of the hub. It shall be noted that the plurality of first radial stiffeners 1155 may not necessarily be axis-symmetrically distributed on the top member 1153 in a uniform manner. In some embodiments, a first radial stiffener 1155 may have a constant cross-section along its length direction. In some other embodiments, a first radial stiffener 1155 may have a variable cross-section along its length direction. For example, each of the first radial stiffeners 1155 comprise an extended portion 1156 near the outer angular stiffener 1159 in some embodiments as illustrated in FIGS. 11A-B to further reinforce the impeller or the hub of the impeller to have more desirous mechanical or acoustic properties.

The impeller 1150 may further include an inner angular stiffener 1158 or an outer angular stiffener 1159 in some embodiments. In the illustrated embodiment comprising both the inner angular stiffener 1158 and the outer angular stiffener 1159, the height of the inner angular stiffener 1158 is shorter than that of the outer angular stiffener 1159 even though the height of the inner angular stiffener 1158 may be longer than that of the outer angular stiffener 1159 in some embodiments. In some embodiments, the ratio between the height of the inner angular stiffener 1158 and that of the outer angular stiffener 1159 may range from 1:1 to 1:15, depending upon one or more weighted or non-weighted factors including, for example but not limited to, the operation requirement(s) of the impeller (e.g., the rotation or spinning speed, the driving power, etc.), the materials of components, the mechanical properties or requirements of the impeller assembly (e.g., the moment of inertia, the resonance frequency, the natural frequency of vibration of the impeller assembly or system, mechanical resonance, acoustic resonance, strength requirement(s), rigidity requirement(s), etc.), cost, manufacturability, reliability of one or more components or the entire impeller assembly, the design of other related component(s), fluid flow requirements (e.g., flow rate, flow field characteristics, etc.), or any combinations thereof, etc. in some embodiments.

In the specific exemplary embodiment illustrated in FIGS. 11A-B, the ratio between the height of the inner angular stiffener 1158 and that of the outer angular stiffener 1159 is about 1:6. In addition or in the alternative, the height of the sidewall 1154 is longer than both the height of the inner angular stiffener 1158 and that of the outer angular stiffener 1159 in the illustrated embodiments, although one or both of the height of the inner angular stiffener 1158 and that of the outer angular stiffener 1159 may be longer than the height of the sidewall 1154 in some other embodiments as a matter of design choice or one or more other factors. The exact profile of a first stiffener 1155 may be determined based at least in part upon one or more weighted or non-weighted factors including, for example but not limited to, the operation requirement(s) of the impeller (e.g., the rotation or spinning speed, the driving power, etc.), the materials of components, the mechanical properties or requirements of the impeller assembly (e.g., the moment of inertia, the resonance frequency, the natural frequency of vibration of the impeller assembly or system, mechanical resonance, acoustic resonance, strength requirement(s), rigidity requirement(s), etc.), cost, manufacturability, reliability of one or more components or the entire impeller assembly, the design of other related component(s), fluid flow requirements, or any combinations thereof, etc. in some embodiments.

The exemplary impeller 1150 may further comprise a plurality of second radial stiffeners 1157 that are situated between the sidewall 1154 and the outer angular stiffener 1159. In some embodiments illustrated in FIGS. 11A-B, a second radial stiffener 1157 may have a wedge-shape and may be disjoint from the outer angular stiffener 1159 such that the second radial stiffener 1157 is only indirectly connected to the outer angular stiffener 1159 through the top member 1153 of the hub 1151.

In addition or in the alternative, the plurality of second radial stiffeners 1157 may be located in such a manner that these second radial stiffeners offset from the first radial stiffeners 1155 at one or more offset distances such that at least one of the plurality of second radial stiffeners 1157 is not aligned with any of the plurality of the first radial stiffeners 1155. The exact geometric dimensions of various stiffeners or various other components of an impeller may be determined based at least in part upon the one or more weighted or non-weighted factors provided herein.

In some embodiments, the hub 1151 may further comprise one or more structural features 1190 along the inner diameter surface of the inner angular stiffener 1158. One of the objectives of these structural features 1190 is to further reinforce the central portion of the hub 1151 where the impeller is used to transfer the torque from the power source to drive the plurality of blades (not completely shown in FIGS. 11A-B). In the embodiments illustrated in FIGS. 11A-B, these structural features 1190 are distributed in a substantially axis-symmetric manner to accommodate the rotational or spinning nature of the impeller during operation.

In addition, each of these structure features 1190 comprises substantially semi-cylindrical shape having substantially the same height as the inner angular stiffener 1158 in the embodiments illustrated in FIGS. 11A-B. Nonetheless, these structure features 1190 need not necessarily have the same geometric dimensions, and the as-designed dimensions of these structural features 1190 may be determined based at least in part upon one or more weighted or non-weighted factors including, for example but not limited to, the operation requirement(s) of the impeller (e.g., the rotation or spinning speed, the driving power, etc.), the materials of components, the mechanical properties or requirements of the impeller assembly (e.g., the moment of inertia, the resonance frequency, the natural frequency of vibration of the impeller assembly or system, mechanical resonance, acoustic resonance, strength requirement(s), rigidity requirement(s), etc.), cost, manufacturability, reliability of one or more components or the entire impeller assembly, the design of other related component(s), etc. in some embodiments.

In the foregoing specification, the invention has been described with reference to specific embodiments thereof. It will, however, be evident that various modifications and changes may be made thereto without departing from the broader spirit and scope of the invention. For example, the above-described process flows are described with reference to a particular ordering of process actions. However, the ordering of many of the described process actions may be changed without affecting the scope or operation of the invention. The specification and drawings are, accordingly, to be regarded in an illustrative rather than restrictive sense.

The invention claimed is:

1. An impeller, comprising:

a hub that includes a top structural member and a first cylindrical feature;

a number of blades attached to the first cylindrical feature;

a first rib attached to the top structural member; and a second rib attached to at least a bottom portion of the first cylindrical feature and at least a portion of the top structural member, wherein the entire second rib is located on the outside of the first rib in a radial direction of the first cylindrical feature, and there is a void between the first rib and the second rib.

2. The impeller of claim 1, wherein the first rib is not connected to the second rib and the void is a space formed between the first rib and the second rib.

3. The impeller of claim 2, wherein: the hub further comprises a second cylindrical feature substantially concentric with the first cylindrical feature, and both the first cylindrical feature and the second cylindrical feature are substantially cylindrical.

4. The impeller of claim 3, wherein the first rib is separately attached to or is inseparably formed as an integral part of the second cylindrical feature, and the number of blades are separably or inseparably attached to the first cylindrical feature.

5. The impeller of claim 3, wherein the first cylindrical feature is separably attached to or is inseparably formed as a part of the top structural member, and the first rib extends outward from a center of the hub and protrudes beyond an outer diameter of the second cylindrical feature and is separably or inseparably attached to the top structural member.

6. The impeller of claim 3, wherein the first cylindrical feature and the second cylindrical feature are configured to exhibit a height ratio ranging from 1:1 to 3:1 to reduce a noise level during a stage of operation of the impeller.

7. The impeller of claim 2, wherein the first rib extends away from a center of the hub and comprises a straight shape or a curved shape with a constant cross-sectional profile or a variable cross-sectional profile.

8. The impeller of claim 2, wherein the second rib corresponds to the first rib in that the second rib resides substantially along an imaginary line extending along a lengthwise direction of the first rib and is disjoint from the first rib.

9. The impeller of claim 2, wherein the first rib comprises a first straight segment having a first orientation that is at a first angle from a first imaginary radial line extending from a center of the hub and connecting to a first point on the first rib.

10. The impeller of claim 9, wherein:

the impeller comprises a plurality of first ribs, and the plurality of first ribs correspond to one or more first orientations relative to respective imaginary radial lines, the hub comprises a straight segment that is separately attached to or is inseparably formed as an integral part of the second rib and includes a different cross-sectional profile, and the straight segment extends along a first direction along the first cylindrical feature.

11. The impeller of claim 1, wherein the first rib is connected to the second rib and the void is a groove formed between the first rib and the second rib.

12. An apparatus for driving fluids, comprising:

a hub comprising a first cylindrical feature and a top structural member, wherein the hub comprises:

a first rib attached to the top structural member, and a second rib attached to at least a bottom portion of the first cylindrical feature and at least a portion of the top structural member;

a number of blades separably attached to the hub; and a power source whose output is directly coupled to the hub or indirectly coupled to the hub through at least a transmission mechanism to drive the number of blades, wherein the entire second rib is located on the outside of the first rib in a radial direction of the first cylindrical feature, and there is a void between the first rib and the second rib.

13. The apparatus of claim 12, wherein the first rib is not connected to the second rib and the void is a space formed between the first rib and the second rib.

14. The apparatus of claim 13, the hub further comprising: a second cylindrical feature substantially concentric with the first cylindrical feature, wherein both the first cylindrical feature and the second cylindrical feature are substantially cylindrical.

15. The apparatus of claim 14, wherein:

the first rib is separately attached to or is inseparably formed as an integral part of the second cylindrical feature, the first cylindrical feature is separably attached to or is inseparably formed as an integral part of the top structural member, and the first rib extends outward from a center of the hub.

16. The apparatus of claim 14, wherein the first cylindrical feature and the second cylindrical feature are configured to exhibit a height ration ranging from 1:1 to 3:1 to reduce a noise level during a stage of operation of the impeller.

17. The apparatus of claim 13, wherein:

the first rib resides on a first surface of the top structural member and is disjoint from the second rib, and the first rib extends away from a center of the hub and comprises a straight shape or a curved shape with a constant cross-sectional profile or variable cross-sectional profile.

18. The apparatus of claim 13, wherein the second rib corresponds to the first rib in that the second rib resides substantially along an imaginary line extending along a lengthwise direction of the first rib and is disjoint from the first rib.

19. A method for reducing noise levels in driving fluids, comprising:

identifying an impeller that comprises a hub and a number of blades that is separably attached to or is inseparably formed as an integral feature of the hub, wherein the hub comprises a top structural member and a first cylindrical feature;

reinforcing the hub by using at least a first rib and a second rib, wherein the first rib is attached to the top structural member, the second rib is attached to at least a bottom portion of the first cylindrical feature and at least a portion of the top structural member, the entire second rib is located on the outside of the first rib in a radial direction of the first cylindrical feature, and there is a void between the first rib and the second rib; and using at least the hub to reduce a noise level at a stage of operation of driving one or more fluids using the impeller.

20. The method of reducing noise levels in driving fluids of claim 19, wherein the first rib is not connected to the second rib and the void is a space formed between the first rib and the second rib.

21. The method of reducing noise levels in driving fluids of claim 20, the act of using at least the hub to reduce the noise level further comprising:

identifying a second cylindrical feature on the hub, wherein the second cylindrical feature is substantially concentric with the first cylindrical feature, and both the first cylindrical feature and the second cylindrical feature are substantially cylindrical.

22. The method of claim 21, wherein:

the first rib extends outward from a center of the hub, the first rib is separately attached to or is inseparably formed as an integral part of the second cylindrical feature, and the first rib resides on a first surface of the top structural member and is disjoint from the second rib.

23. The method of claim 21, wherein the first cylindrical feature and the second cylindrical feature are configured to exhibit a height ratio ranging from 1:1 to 3:1 to reduce a noise level during a stage of operation of the impeller.

24. An impeller, comprising:

a hub that includes a top member and a cylindrical sidewall;

a number of blades attached to the cylindrical sidewall;

a first radial stiffener separably fixed on or inseparably formed as a part of the top member and extended outward from a center of the hub;

a second radial stiffener situated between the sidewall and the first radial stiffener, wherein there is a void between the first radial stiffener and the second radial stiffener;

wherein the impeller further comprises a cylindrical stiffener situated in the cylindrical sidewall and substantially concentric with the cylindrical sidewall, the first radial stiffener extends outward from the center of the hub to the cylindrical stiffener, the second radial stiffener is situated between the sidewall and the cylindrical stiffener, and the second radial stiffener is disjoint from the cylindrical stiffener.

25. The impeller of claim 24, wherein the second radial stiffener offsets from the first radial stiffener such that the second radial stiffener is not aligned with the first radial stiffener.

26. The impeller of claim 24, wherein the first radial stiffener is not connected to the second radial stiffener and the void is a space formed between the first radial stiffener and the second radial stiffener.

27. The impeller of claim 24, wherein the first radial stiffener is connected to the second radial stiffener and the void is a groove formed between the first radial stiffener and the second radial stiffener.

28. An impeller, comprising:

a hub that includes a top structural member and a first cylindrical feature;

a number of blades attached to the first cylindrical feature;

a first rib attached to the top structural member; and a second rib attached to at least a bottom portion of the first cylindrical feature and at least a portion of the top structural member, wherein there is a void between the first rib and the second rib, the first rib is connected to the second rib and the void is a groove formed between the first rib and the second rib.

* * * * *